US011521551B2

(12) United States Patent
Onoyama et al.

(10) Patent No.: US 11,521,551 B2
(45) Date of Patent: Dec. 6, 2022

(54) DISPLAY DEVICE, METHOD OF DRIVING DISPLAY DEVICE, AND ELECTRONIC APPARATUS

(71) Applicant: Sony Group Corporation, Tokyo (JP)

(72) Inventors: Yusuke Onoyama, Kanagawa (JP); Kei Kimura, Kanagawa (JP)

(73) Assignee: Sony Group Corporation, Tokyo (JP)

( * ) Notice: Subject to any disclaimer, the term of this patent is extended or adjusted under 35 U.S.C. 154(b) by 0 days.

(21) Appl. No.: 14/656,982

(22) Filed: Mar. 13, 2015

(65) Prior Publication Data

US 2015/0279266 A1 Oct. 1, 2015

(30) Foreign Application Priority Data

Mar. 27, 2014 (JP) ..... JP2014-065308

(51) Int. Cl.
*G09G 3/3266* (2016.01)
*G09G 3/3225* (2016.01)

(52) U.S. Cl.
CPC ..... *G09G 3/3266* (2013.01); *G09G 3/3225* (2013.01); *G09G 2300/0408* (2013.01); *G09G 2300/0842* (2013.01); *G09G 2310/0213* (2013.01); *G09G 2310/0224* (2013.01);
(Continued)

(58) Field of Classification Search
CPC ..... G09G 3/3266; G09G 3/3225; G09G 2300/0842; G09G 2310/0224; G09G 2320/0219; G09G 2310/0213; G09G 2310/0291; G09G 2320/0233; G09G 2300/0408
See application file for complete search history.

(56) References Cited

U.S. PATENT DOCUMENTS 5,748,165 A * 5/1998 Kubota ..... G09G 3/2011 345/96
6,034,553 A * 3/2000 Kwong ..... H03K 17/165 326/113

(Continued)

FOREIGN PATENT DOCUMENTS

JP 2006-301581 11/2006

OTHER PUBLICATIONS

Ray Marston, Understanding Digital Logic ICs Part 4—Modern CMOS Digital ICs, Nuts and Volts Magazine (Oct. 2006).*

*Primary Examiner* — Temesghen Ghebretinsae
*Assistant Examiner* — Ivelisse Martinez Quiles
(74) *Attorney, Agent, or Firm* — Michael Best & Friedrich LLP

(57) ABSTRACT

Provided is a display device including: a pixel array unit in which pixels including a light-emitting unit are arranged in a matrix shape; two drive units which are disposed on the same substrate as the pixel array unit with the pixel array unit interposed therebetween, which have output stages in a number that is half of the number of pixel rows of the pixel array unit, and in which the output stages are in charge of driving of pixels on an odd row side and on an even row side; and a control unit which performs control of driving the pixels on the odd row side by using the output stages of one drive unit between the two drive units, of driving the pixels on the even row side by using the output stages of the other drive unit, and of inverting the driving for each field.

17 Claims, 15 Drawing Sheets

(52) U.S. Cl.
CPC ..... *G09G 2310/0291* (2013.01); *G09G 2320/0219* (2013.01); *G09G 2320/0233* (2013.01)

(56) References Cited

U.S. PATENT DOCUMENTS 6,628,253 B1 * 9/2003 Hiroki ..... G09G 3/3614 345/209
8,614,701 B2 * 12/2013 Watanabe ..... G09G 3/3648 345/100
2001/0035849 A1 * 11/2001 Kimura ..... G09G 3/3266 345/76
2006/0232519 A1 10/2006 DuHwan et al.
2007/0001205 A1 * 1/2007 Kimura ..... G09G 3/3241 257/296
2007/0075954 A1 * 4/2007 Oh ..... G09G 3/3258 345/92
2007/0089000 A1 * 4/2007 Shin ..... G09G 3/3266 714/726
2007/0176553 A1 * 8/2007 Kwak ..... H01L 51/524 313/512
2008/0291182 A1 * 11/2008 Yamashita ..... G09G 3/3233 345/204
2009/0121984 A1 * 5/2009 Yamamoto ..... G09G 3/3233 345/76
2009/0251404 A1 * 10/2009 Hwang ..... G09G 3/344 345/107
2011/0221721 A1 * 9/2011 Tsou ..... G09G 3/20 345/206
2012/0062528 A1 * 3/2012 Kimura ..... G09G 3/3677 345/204
2013/0026929 A1 * 1/2013 Kasai ..... G09G 3/003 315/160
2013/0088479 A1 * 4/2013 Kim ..... G09G 3/3614 345/212
2013/0093739 A1 * 4/2013 Kim ..... G09G 3/3648 345/206
2013/0100173 A1 * 4/2013 Chaji ..... G09G 3/3275 345/690
2013/0113780 A1 * 5/2013 Miyatake ..... G06F 3/0412 345/212
2014/0184484 A1 * 7/2014 Miyake ..... G09G 3/3677 345/87
2014/0252988 A1 * 9/2014 Azizi ..... H05B 33/0848 315/307
2014/0292823 A1 * 10/2014 Lee ..... G09G 3/3225 345/690
2015/0171861 A1 * 6/2015 Aherne ..... H03K 17/6872 327/437
2015/0262528 A1 * 9/2015 Takahara ..... G09G 3/3225 345/212
2017/0330515 A1 * 11/2017 Jeong ..... G09G 3/3258

* cited by examiner

DISPLAY DEVICE, METHOD OF DRIVING DISPLAY DEVICE, AND ELECTRONIC APPARATUS

CROSS REFERENCE TO RELATED APPLICATIONS

This application claims the benefit of Japanese Priority Patent Application JP 2014-065308 filed Mar. 27, 2014, the entire contents of which are incorporated herein by reference.

BACKGROUND

The present disclosure relates to a display device, a method of driving a display device, and an electronic apparatus.

With regard to the display device, a method of mounting a drive unit, which drives a pixel (pixel circuit) including a light-emitting unit, is classified into a panel built-in type in which the drive unit is disposed on the same substrate as a pixel array unit, that is, on the same panel, and an externally attached panel type in which the drive unit is disposed at the outside of the substrate. In the related art, in the panel built-in type display device, to correspond to the narrowing of a pixel pitch in accordance with high-definition, a so-called one-side driving configuration, in which pixels on an odd row side are driven by one drive unit between two drive units disposed with the pixel array unit interposed therebetween, and pixels on an even row side are driven by the other drive unit, has been employed (for example, refer to Japanese Unexamined Patent Application Publication No. 2006-301581).

SUMMARY

In the related art employing the one-side driving configuration, each of the two drive units is driven in a state in which the entire pixels in one pixel row are set as a load, and thus a great difference (transient difference) is apt to occur in a transient of a pulse that drives pixels between a right side and a left side of the panel in accordance with a load distribution constant. The transient difference has a great effect on a gate voltage of a drive transistor that drives a light-emitting unit. As a result, a luminance distribution (shading) inside the panel occurs.

It is desirable to provide a display device, a method of driving a display device, and an electronic apparatus which are capable of mitigating shading that occurs during one-side driving by two drive units which are disposed with a pixel array unit interposed therebetween.

According to an embodiment of the present disclosure, there is provided a display device including: a pixel array unit in which pixels including a light-emitting unit are arranged in a matrix shape; two drive units which are disposed on the same substrate as the pixel array unit with the pixel array unit interposed therebetween, which have output stages in a number that is half of the number of pixel rows of the pixel array unit, and in which the output stages are in charge of driving of pixels on an odd row side and on an even row side; and a control unit which performs control of driving the pixels on the odd row side by using the output stages of one drive unit between the two drive units, of driving the pixels on the even row side by using the output stages of the other drive unit, and of inverting the driving for each field.

According to another embodiment of the present disclosure, there is provided a method of driving a display device that includes a pixel array unit in which pixels including a light-emitting unit are arranged in a matrix shape, and two drive units which are disposed on the same substrate as the pixel array unit with the pixel array unit interposed therebetween, which have output stages in a number that is half of the number of pixel rows of the pixel array unit, and in which each of the output stages is in charge of driving of pixels on an odd row side and on an even row side. The method includes driving pixels on the odd row side by using the output stages of one drive unit between the two drive units, driving pixels on the even row side by using the output stages of the other drive unit, and inverting the driving for each field.

According to still another embodiment of the present disclosure, there is provided an electronic apparatus including a display device. The display device includes: a pixel array unit in which pixels including a light-emitting unit are arranged in a matrix shape; two drive units which are disposed on the same substrate as the pixel array unit with the pixel array unit interposed therebetween, which have output stages in a number that is half of the number of pixel rows of the pixel array unit, and in which the output stages are in charge of driving of pixels on an odd row side and on an even row side; and a control unit which performs control of driving the pixels on the odd row side by using the output stages of one drive unit between the two drive units, of driving the pixels on the even row side by using the output stages of the other drive unit, and of inverting the driving for each field.

In the display device, the method of driving a display device, or the electronic apparatus which has the above-described configuration, the two drive units, which are disposed on the same substrate as the pixel array unit with the pixel array unit interposed therebetween, have output stages in a number that is half of the number of pixel rows of the pixel array unit, and thus it is possible to construct the output stages with a pitch two times a pixel pitch. In addition, the output stages of one drive unit between the two drive units drive pixels on an odd row side, the output stages of the other drive unit drive pixels on an even row side, and the driving is inverted for each field, and thus a luminance distribution (shading) in a panel is inverted for each field.

According to the present disclosure, the luminance distribution inside the panel is inverted for each field, and thus with regard to visual information, luminance is composed (retina composition). According to this, a luminance difference is averaged, and thus it is possible to mitigate shading which occurs during one-side driving.

However, the effect described here is not limited, and any effect described in this specification is also possible. In addition, the effect described in this specification is illustrative only, there is no limitation thereto, and an additional effect is also possible.

BRIEF DESCRIPTION OF THE DRAWINGS

FIGS. 14A and 14B are external appearance views of a lens-interchangeable single-lens reflex type digital still camera, in which FIG. 14A is a front view and FIG. 14B is a rear view.

DETAILED DESCRIPTION OF EMBODIMENTS

Figure 1:
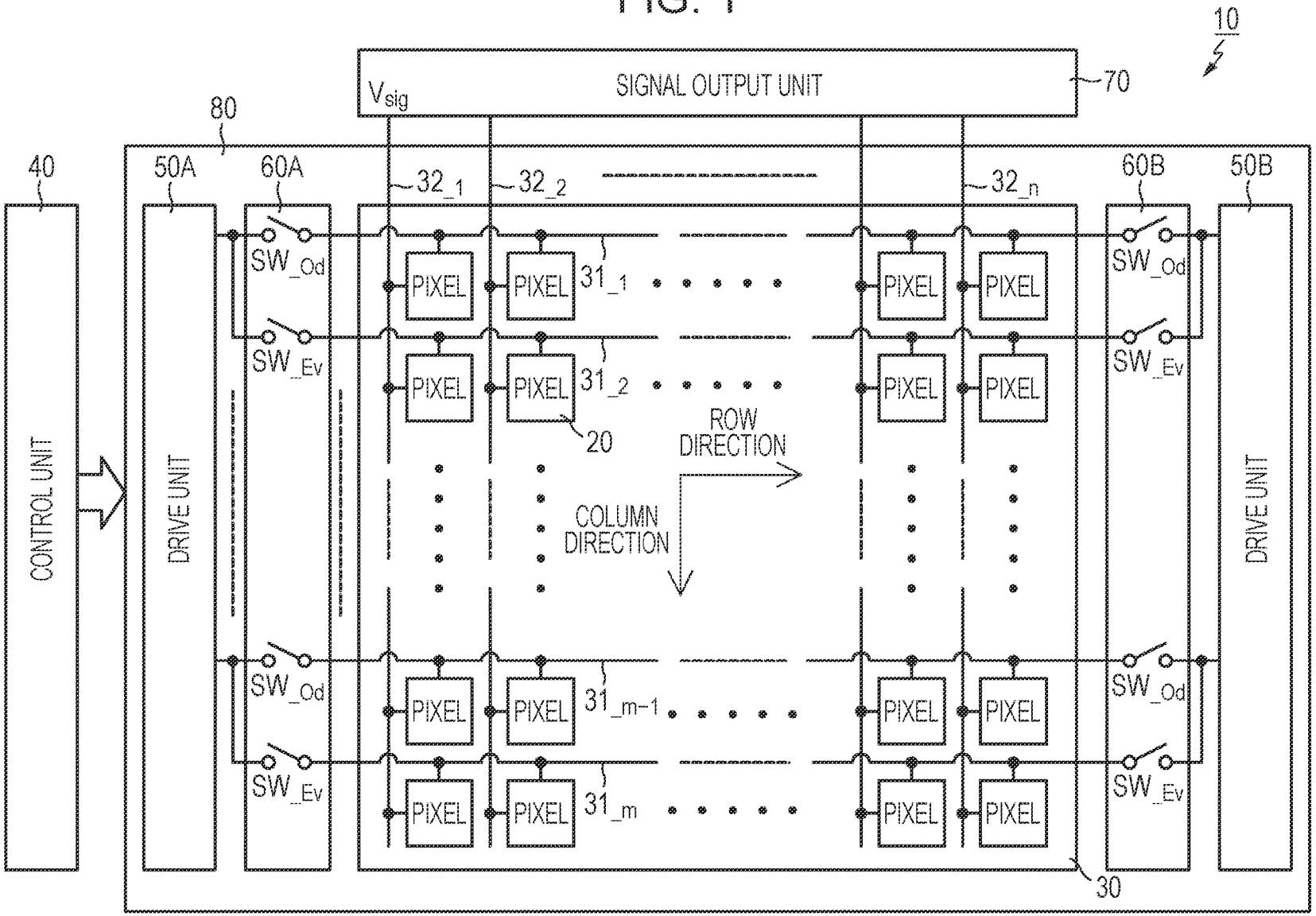
FIG. 1 is a system configuration view schematically illustrating a basic configuration of an active matrix type display device according to an embodiment of the present disclosure.

Hereinafter, an embodiment for carrying out the technology of the present disclosure (hereinafter, referred to as an "embodiment") will be described in detail with reference to the attached drawings. The technology of the present disclosure is not limited to the embodiment, and various numerical values and the like in the embodiment are illustrative only. In the following description, the same reference numeral will be given to the same elements or elements having the same function, and redundant description will not be repeated. The description will be made in the following order.

1. Overall Description of Display Device, Method of Driving Display Device, and Electronic Apparatus of Present Disclosure
2. Active Matrix Type Display Device According to Embodiment (Example of Organic El Display Device)
   2-1. System Configuration
   2-2. Pixel Circuit
   2-3. Phenomenon of Panel Built-in Type Display Device
   2-4. One-Side Driving According to Related Art
   2-5. One-Side Driving According to Embodiment
3. Modification Example of Embodiment
4. Electronic Apparatus (Example of Digital Still Camera and Head Mount Display)

Overall Description of Display Device, Method of Driving Display Device, and Electronic Apparatus of Present Disclosure In a display device, a method of driving a display device, and an electronic apparatus of the present disclosure, each of two drive units can be configured to include two switches which selectively establish a connection between each output stage and each scanning line on an odd row side, and a connection between the output stage and each scanning line on an even row side.

In the display device, the method of driving the display device, and the electronic apparatus including the above-described preferred configuration, the control unit may be configured in such a manner that when turning on a switch on an odd row side and turning off a switch on an even row side with respect to the two switches on one side of the two drive units, a switch on an even row side is turned on and a switch on an odd row side is turned off with respect to the two switches on the other side of the two drive units. In addition, the on/off control of the two switches may be configured to be switched for each field.

The display device of the present disclosure may be configured to include: a pixel array unit in which pixels including a light-emitting unit are arranged in a matrix shape; two drive units which are disposed on the same substrate as the pixel array unit with the pixel array unit interposed therebetween, which have output stages in a number that is half of the number of pixel rows of the pixel array unit, and in which the output stages are in charge of driving of pixels on an odd row side and on an even row side; and a switch unit in which two switches, which selectively establish a connection between each output stage of the two drive units and each scanning line on an odd row side and a connection between the output stage and each scanning line on an even row side, are disposed for every output stages of the two drive units.

Furthermore, the display device of the present disclosure may be configured to include a pixel array unit in which pixels including a light-emitting unit are arranged in a matrix shape, a first scanning line that is commonly connected to pixels which are arranged in a first row, a first switch, a second switch; a first drive unit, and a second drive unit. In addition, an output stage of the first drive unit may be connected to one end of the first scanning line through the first switch, an output stage of the second drive unit may be connected to the other end of the first scanning line through the second switch, and when the first switch enters a conduction state, the second switch may enter a non-conduction state.

In addition, the display device may further include a second scanning line that is commonly connected to pixels which are arranged in a second row, a third switch, and a fourth switch. In addition, the output stage of the first drive unit may be connected to an end of the second scanning line through the third switch, and the output stage of the second drive unit may be connected to the other end of the second scanning line through the fourth switch. When the third switch enters a conduction state, the fourth switch may enter a non-conduction state, and when the first switch enters a conduction state, the third switch may enter a non-conduction state.

Active Matrix Type Display Device According to Embodiment

System Configuration

FIG. 1 is a system configuration view schematically illustrating a basic configuration of an active matrix type display device according to an embodiment of the present disclosure.

The active matrix type display device is a display device that controls a current flowing through a light-emitting element (light-emitting unit) by an active element provided in the same pixel circuit as the light-emitting element, for example, an insulating gate type field effect transistor. As the insulating gate type field effect transistor, typically, a thin film transistor (TFT) may be used.

Here, as an example, description will be made with reference to an active matrix type organic EL display device in which as the light-emitting element of the pixel circuit, for example, an organic EL element is used. The organic EL element is a light-emitting element, and is a current drive type electro-optical element in which light-emission luminance varies in accordance with a value of a current flowing through a device. Hereinafter, the "pixel circuit" may be simply referred to as a "pixel" in some cases.

As illustrated in FIG. 1, an organic EL display device 10 according to the embodiment of the present disclosure includes a pixel array unit 30 in which a plurality of pixels 20 including the organic EL element are two-dimensionally arranged in a matrix shape, a peripheral drive unit that is disposed at the periphery of the pixel array unit 30, and a control unit 40 that controls the entirety of a system. The peripheral drive unit includes two drive units 50A and 50B, two switch units 60A and 60B, a signal output unit 70, and the like, and drives respective pixels 20 of the pixel array unit 30.

The two drive units 50A and 50B, and the two switch units 60A and 60B are mounted on the same substrate as the pixel array unit 30, and constitute a display panel 80 (panel built-in type). As a substrate of the display panel 80, a transparent insulating substrate such as a glass substrate may be used, or a semiconductor substrate such as a silicon substrate may be used. The two drive units 50A and 50B are disposed with the pixel array unit 30 interposed therebetween. The switch unit 60A is disposed between the drive unit 50A and the pixel array unit 30, and the switch unit 60B is disposed between the drive unit 50B and the pixel array unit 30. In this example, the signal output unit 70 has an externally attached configuration in which the signal output unit 70 is disposed outside the display panel 80. However, as is the case with the drive units 50A and 50B, and the like, it is also possible to employ a configuration in which the signal output unit 70 is mounted on the same substrate as the pixel array unit 30.

Here, in a case where the organic EL display device 10 capable of corresponding to color display, one pixel (unit pixel), which becomes a unit of forming a color image, is constituted by a plurality of sub-pixels. At this time, each of the sub-pixels corresponds to a pixel 20 in FIG. 1. More specifically, in the display device capable of corresponding to color display, for example, one pixel is constituted by three sub-pixels such as a sub-pixel including a light-emitting unit that emits a red (R) light beam, a sub-pixel including a light-emitting unit that emits a green (G) light beam, and a sub-pixel including a light-emitting unit that emits a blue (B) light beam.

However, the one pixel is not limited to a combination of the sub-pixels of RGB three primary colors, and the one pixel may be configured by further adding sub-pixels of one color or a plurality of colors to the sub-pixels of the three primary colors. More specifically, for example, the one pixel may be configured by adding a sub-pixel including a light-emitting unit that emits white (W) light beam so as to improve luminance, or the one pixel may be configured by adding at least one sub-pixel including a light-emitting unit that emits a complementary color light beam so as to enlarge a color reproducing range.

In the pixel array unit 30, each of scanning lines 31 ($\mathbf{31}_{_1}$ to $\mathbf{31}_{_m}$) is interconnected for each pixel row along a row direction (a direction along a pixel row/horizontal direction) with respect to arrangement of pixels 20 of m rows and n columns. In addition, each of signal lines 32 ($\mathbf{32}_{_1}$ to $\mathbf{32}_{_m}$) is interconnected for each pixel column along a column direction (a direction along a pixel column/vertical direction) with respect to arrangement of the pixels 20 of m rows and n columns.

In a unit of two rows including an odd row and an even row which are adjacent to each other, ends on both sides of the scanning lines 31 ($\mathbf{31}_{_1}$ to $\mathbf{31}_{_m}$) are connected to output stages on a corresponding row side of the drive units 50A and 50B through the switch units 60A and 60B, respectively. Each of the signal lines 32 ($\mathbf{32}_{_1}$ to $\mathbf{32}_{_m}$) is connected to an output stage on a corresponding column side of the signal output unit 70.

The drive units 50A and 50B include a shift register circuit, and the like, and are configured to have output stages (unit circuits) in a number that is half of the number of pixel rows of the pixel array unit 30. In addition, the drive units 50A and 50B drive pixels 20 in an odd row and an even row which are adjacent to each other under the control by the control unit 40. During the driving, with respect to the two drive units 50A and 50B, the control unit 40 performs control of driving pixels 20 on an odd row side by using output stages of one drive unit between the drive units 50A and 50B, of driving pixels 20 on an even row side by using output stages of the other drive unit, and of inverting the driving for each field.

The switch units 60A and 60B have a configuration in which two switches $SW_{_Od}$ and $SW_{_Ev}$, each being disposed between an output stage of each of the drive units 50A and 50B and each of the scanning lines 31 ($\mathbf{31}_{_1}$ to $\mathbf{31}_{_m}$) on an odd row side and on an even row side which are adjacent to each other, are disposed for every output stages of the drive units 50A and 50B. Specifically, in the switch units 60A and 60B, each of the two switches $SW_{_Od}$ and $SW_{_Ev}$ is connected between an output stage on an initial stage side of each of the drive units 50A and 50B and each of scanning lines $\mathbf{31}_{_1}$ and $\mathbf{31}_{_2}$ on a first row side and a second row side. This is true of an output stage on a second stage side to an output stage on an $m-1^{th}$ stage side, and each of the two switches $SW_{_Od}$ and $SW_{_Ev}$ is connected between an output stage on a final stage side and each of scanning lines $\mathbf{31}_{_m-1}$ and $\mathbf{31}_{_m}$ on an $m-1^{th}$ row side and an $m^{th}$ row side.

With regard to the two drive units which include output stages in a number that is half of the number of pixel rows of the pixel array unit 30, each of the output stages is in charge of driving of pixels on an odd row side and an even row side, and hereinbefore, description has been given to a configuration constituted by the drive units 50A and 50B, but there is no limitation to this configuration. Specifically, the two drive units may have a configuration including the switch units 60A and 60B in addition to the drive units 50A and 50B, that is, a configuration constituted by the drive units 50A and 50B and the switch units 60A and 60B.

The control unit 40 performs the following control with respect to the switch units 60A and 60B. That is, when turning on a switch $SW_{_Od}$ on an odd row side and turning off a switch $SW_{_Ev}$ on an even row side with respect to two switches on one side of the two drive units 50A and 50B, the control unit 40 turns on the switch $SW_{_Ev}$ on the even row side and turns off the switch $SW_{_Od}$ on the odd row side with respect to two switches on the other side of the two drive units 50A and 50B. In addition, the control unit 40 performs control of switching the on/off control of the two switches $SW_{_Od}$ and $SW_{_Ev}$ for each field with respect to the switch units 60A and 60B.

The signal output unit 70 outputs a signal voltage $V_{sig}$ (hereinafter, may be simply referred to as a "signal voltage" in some cases) of a video signal in accordance with luminance information that is supplied from a signal supply source (not illustrated) as a light-emission signal. The signal voltage $V_{sig}$ of the video signal which is output from the signal output unit 70 is written in a unit of pixel row, which is selected by scanning by the drive units 50A and 50B and the switch units 60A and 60B, with respect to the pixels 20 of the pixel array unit 30 through the signal lines 32 ($32_{_1}$ to $32_{_n}$). That is, the signal output unit 70 employs a line-sequential-writing drive type in which the signal voltage $V_{sig}$ is written in a unit of row (line).

Pixel Circuit

Figure 2:
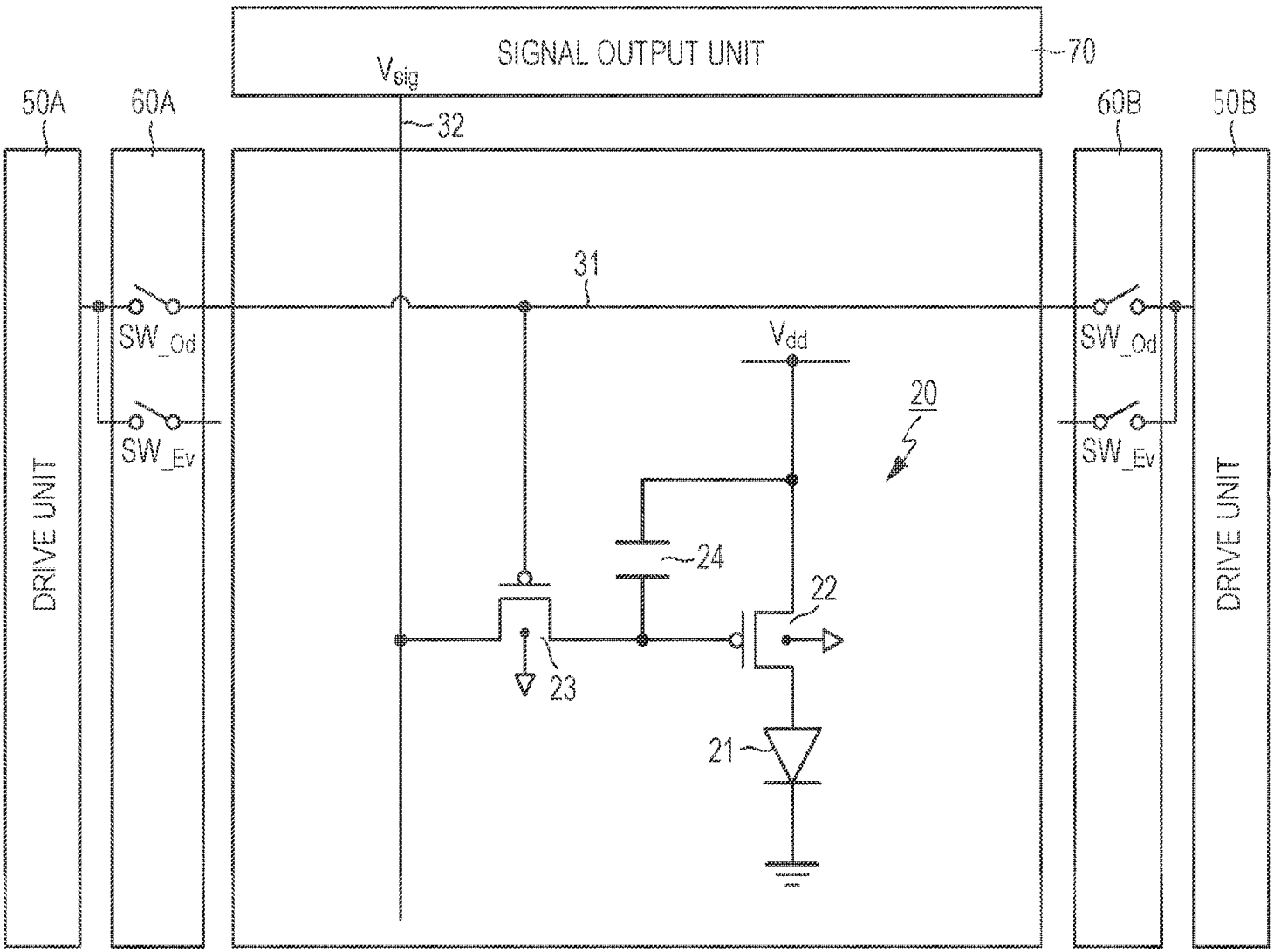
FIG. 2 is a circuit diagram illustrating an example of a specific circuit configuration of a pixel (pixel circuit) in the active matrix type display device according to this embodiment.

FIG. 2 is a circuit diagram illustrating an example of a specific circuit configuration of the pixels (pixel circuits) 20 in the organic EL display device 10 according to the embodiment having the above-described configuration. A light-emitting unit of each of the pixels 20 is constituted by an organic EL element 21. The organic EL element 21 is an example of a current drive type electro-optical element in which light-emission luminance varies in accordance with a value of a current flowing through a device.

As illustrated in FIG. 2, the pixel 20 includes the organic EL element 21, and a drive circuit that allows a current to flow through the organic EL element 21 so as to drive the organic EL element 21. For example, a cathode electrode of the organic EL element 21 is connected to a ground (GND), that is, the cathode electrode is grounded.

The drive circuit that drives the organic EL element 21 has a circuit configuration including a drive transistor 22, a sampling transistor (write transistor) 23, and a retention capacitor 24, that is, a 2Tr1C circuit configuration constituted by two transistors (Tr) and one capacitor unit (C).

Here, as an example, it is assumed that the respective pixels (pixel circuits) 20 of the pixel array unit 30 are formed on a semiconductor such as a silicon substrate not on an insulator such as a glass substrate. Accordingly, the drive transistor 22 and the sampling transistor 23 include four terminals of source/gate/drain/back gate instead of three terminals of source/gate/drain. A power supply voltage $V_{dd}$ is applied to the back gate. Here, as the drive transistor 22 and the sampling transistor 23, a P-channel type transistor is used. However, an N-channel type transistor may also be used, or a combination of the P-channel type transistor and the N-channel type transistor is also possible.

In the pixel 20 having the above-described configuration, the sampling transistor 23 enters a conduction state in response to a scanning pulse which is applied to the gate electrode through each of the scanning lines 31 via each of the switch units 60A and 60B from each of the drive units 50A and 50B and in which a low voltage enters an active state. In addition, when entering a conduction state, the sampling transistor 23 samples the signal voltage $V_{sig}$ of a video signal which is supplied as a light-emission signal from the signal output unit 70 through each of the signal lines 32, and writes the signal voltage $V_{sig}$ in the pixel 20.

The retention capacitor 24 is connected between the gate electrode and the source electrode of the drive transistor 22. In addition, the retention capacitor 24 retains the signal voltage $V_{sig}$ of the video signal which is written by sampling performed by the sampling transistor 23. The drive transistor 22 allows a drive current in accordance with the signal voltage $V_{sig}$, which is retained in the retention capacitor 24, to flow through the organic EL element 21 so as to drive the organic EL element 21.

However, the 2Tr1C circuit configuration of the pixel 20 described here is illustrative only, and there is no limitation thereto. For example, it is possible to employ a circuit configuration including another transistor such as a light-emission control transistor which is connected between a power supply node of the power supply voltage $V_{dd}$ and the source electrode of the drive transistor 22, and which controls light-emission and non-light-emission of the organic EL element 21. In addition, in the circuit configuration including the light-emission control transistor, it is possible to employ a configuration in which a capacitor unit (capacitor element) is connected between the source electrode of the drive transistor 22 and a node of a fixed potential, for example, a power supply node of a power supply voltage $V_{cc}$.

Phenomenon of Panel Built-In Type Display Device

Figure 3:
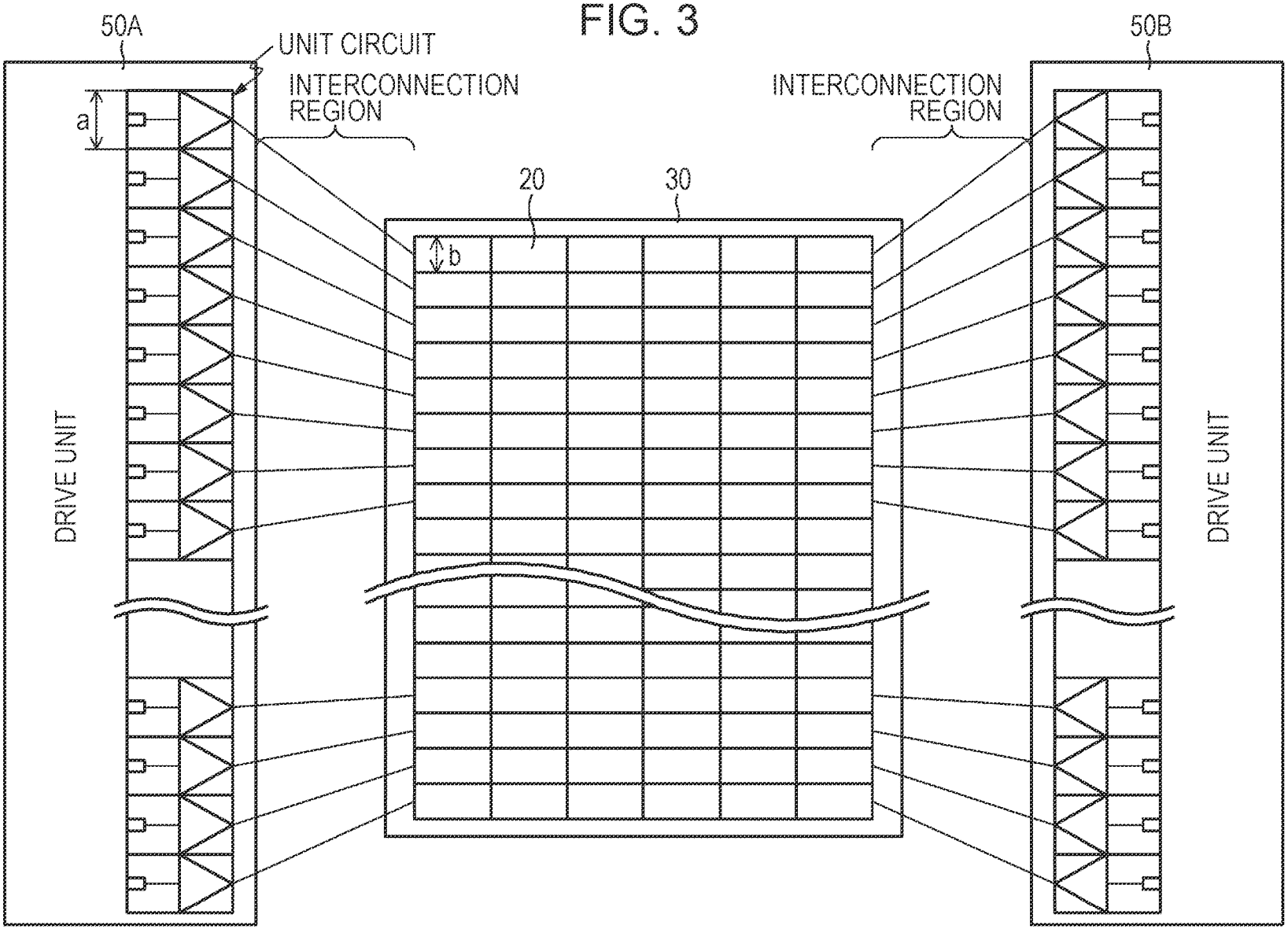
FIG. 3 is a view illustrating a phenomenon of a panel built-in type display device.

However, in a panel built-in type display device in which the drive units 50A and 50B are disposed on the same substrate as the pixel array unit 30 similar to the organic EL display device 10 according to the above-described embodiment, it is necessary to construct the unit circuit of the drive units 50A and 50B, which correspond to each pixel row, with the same pitch as the pixel pitch of the pixel array unit 30. When the pitch of the unit circuit of the drive units 50A and 50B increases further than the pixel pitch, the display panel 80 has a configuration as illustrated in FIG. 3. That is, it is necessary to provide an interconnection region, which is used to adjust the pitch of the pixels 20 and unit circuits of the drive units 50A and 50B, between the pixel array unit 30 and the drive units 50A and 50B.

In FIG. 3, interconnections of the interconnection region are simply drawn as interconnections having inclination angles different from each other. However, typically, a combination of an interconnection having a predetermined inclination angle (for example, 45°) and an interconnection having an inclination angle of 0° is used due to a restriction of design rules in a process. Specifically, with respect to sites other than a site at which the pixels 20 and the unit circuits of the drive units 50A and 50B can be directly connected with an interconnection having a predetermined inclination angle, the pixels 20 and the unit circuits of the drive units 50A and 50B are connected by using a combination of the interconnection having a predetermined inclination angle and the interconnection having an inclination angle of 0°.

In FIG. 3, "a" represents the pitch of the unit circuits of the drive units 50A and 50B, and "b" represents a pixel pitch of the pixel array unit 30. Here, when the number of effective pixels in a vertical direction (column direction) is set as $N_v$, and as an example, interconnection is performed according to the design rule of 45° restriction, a width of the interconnection region becomes $(a-b)\times N_v/2$. As described above, for example, the width (area) of the interconnection region increases due to the restriction of the design rule, and thus an area of a frame portion (peripheral portion of the pixel array unit 30) of the display panel 80 increases. As a result, this increase in area leads to an increase in the cost of the display panel 80 and an increase in the cost of the entirety of the display device.

Recently, additional high-definition has been strongly demanded for the display device (display panel 80), and development has been actively performed to make the pixel pitch narrow. In addition, the narrower the pixel pitch becomes, the more difficult the design of the drive units 50A and 50B becomes in the panel built-in type display device.

One-Side Driving According to Related Art

Figure 4:
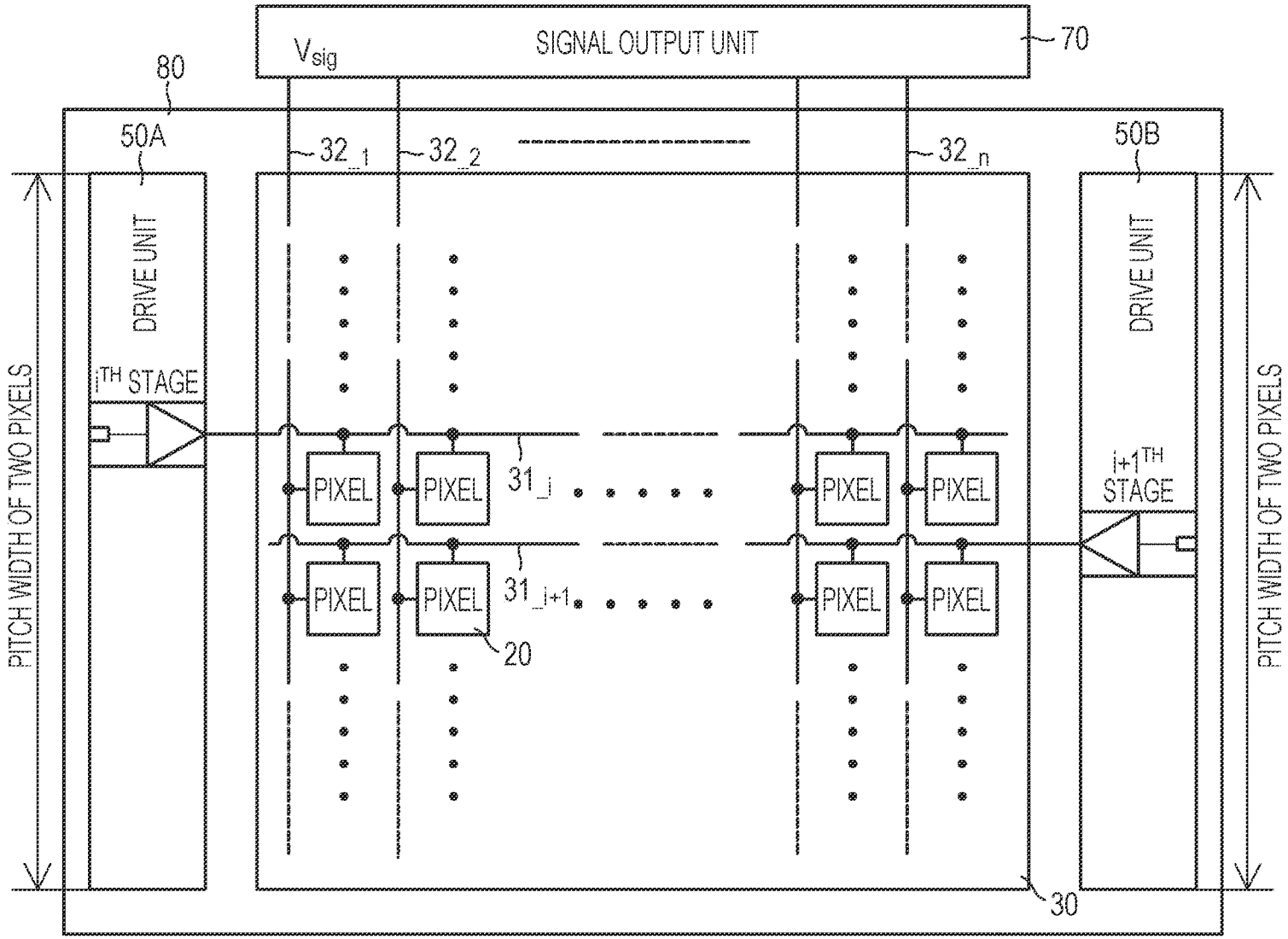
FIG. 4 is a configuration view illustrating a configuration example of one-side driving according to the related art.

As a technology of corresponding to the narrowing of the pixel pitch along with the above-described high-definition, there is a so-called one-side driving in which the pixels 20 on an odd row side are driven by using one drive unit between the two drive units 50A and 50B, and the pixels 20 on an even row side are driven by using the other drive unit. A configuration example of the one-side driving according to the related art is illustrated in FIG. 4. In a case of the one-side driving illustrated in FIG. 4, for example, the drive unit 50A on a left side drives pixels 20 in an odd row ($i^{th}$ row), and the drive unit 50B on a right side drives the pixels 20 in an even row ($i+1^{th}$ row) (the opposite is also possible). The two drive units 50A and 50B are alternatively driven for each one field to apply a scanning pulse to the pixels 20 in the corresponding pixel row. According to the one-side driving, it is possible to construct the unit circuits of the drive units 50A and 50B with a pitch two times the pixel pitch. Accordingly, in principle, it is possible to mitigate the pitch of the unit circuits of the drive units 50A and 50B.

However, in the one-side driving type display device, each of the two drive units 50A and 50B is driven in a state in which the entire pixels in one pixel row are set as a load, and thus a great difference (transient difference) is apt to occur in a transient of a scanning pulse that drives pixels between a right side and a left side of the display panel 80 in accordance with a load distribution constant. The transient difference has a great effect on a gate voltage of a drive transistor 22 (refer to FIG. 2) that drives a light-emitting unit. As a result, a luminance distribution (shading) inside the display panel 80 occurs.

Particularly, an effect of the variation in the gate voltage of the drive transistor 22 becomes significant in a pixel circuit in which a light-emitting unit is configured of a current drive type electro-optical element, and which uses the current drive. In a pixel circuit using the above-described organic EL element 21 as the light-emitting unit, current drive by the drive transistor 22 is used in many cases. The variation in the gate voltage of the drive transistor 22, and the effect thereof will be described below in detail.

Figure 5:
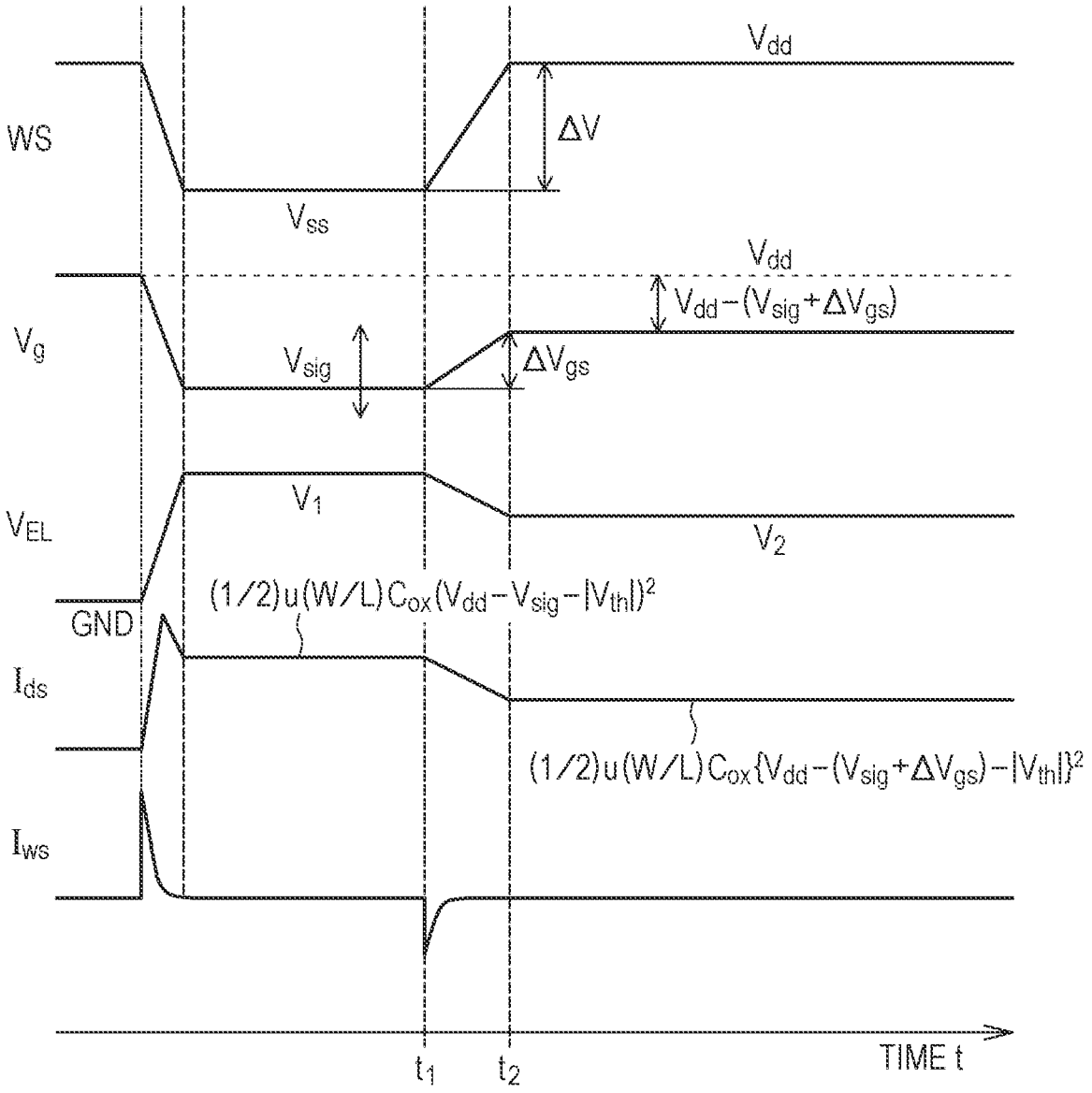
FIG. 5 is a timing waveform chart illustrating a timing relationship during driving of the pixel circuit illustrated in FIG. 2.

FIG. 5 illustrates a timing relationship during driving of the pixel circuit of FIG. 2, that is, the pixel circuit including the organic EL element 21, the drive transistor 22, the sampling transistor 23, and the retention capacitor 24. A timing waveform chart of FIG. 5 illustrates waveforms of a scanning pulse WS that is applied to a gate electrode of the sampling transistor 23, a gate voltage $V_g$ of the drive transistor 22, an anode voltage $V_{EL}$ of the organic EL element 21, a drive current $I_{ds}$ of the organic EL element 21, and a current $I_{WS}$ that flows through the sampling transistor 23.

Figure 6:
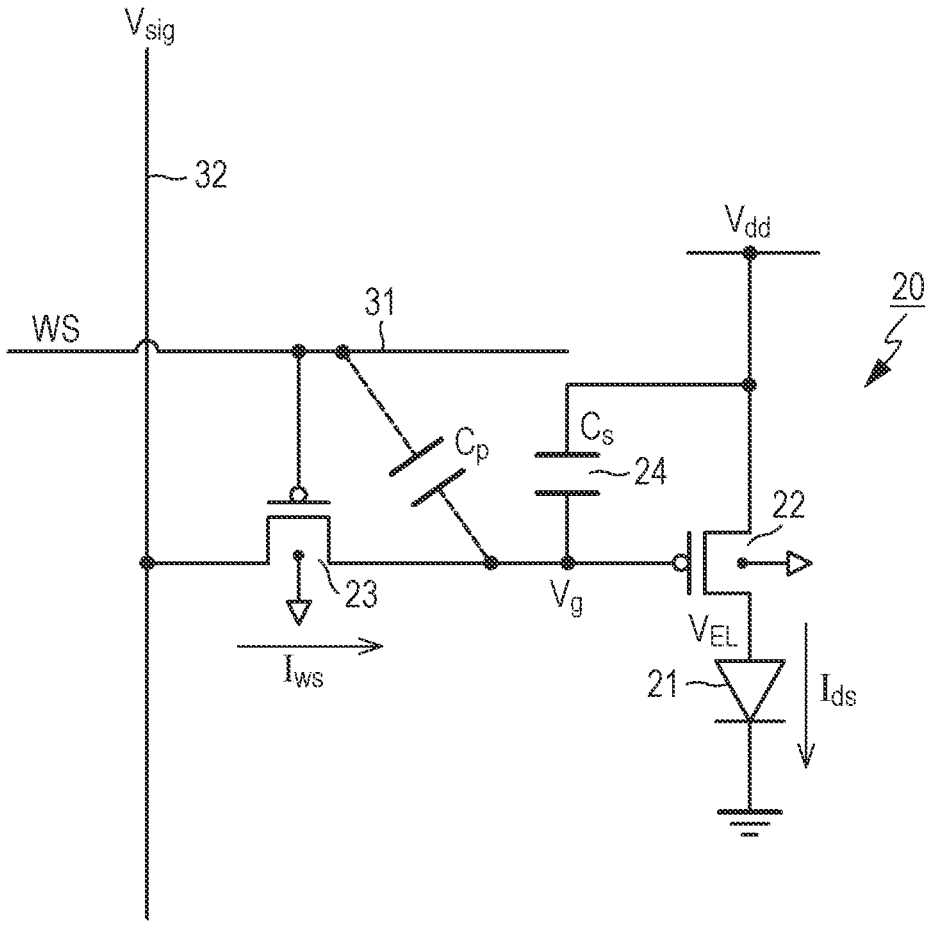
FIG. 6 is an equivalent circuit diagram illustrating a parasitic capacitance $C_p$ that occurs between a scanning line and a gate electrode of a drive transistor.

In the scanning pulse WS, a low level is a low-potential side power supply voltage $V_{SS}$, and a high level is a high-potential side power supply voltage $V_{dd}$. Here, a difference voltage between the low-potential side power supply voltage $V_{SS}$ and the high-potential side power supply voltage $V_{dd}$, that is, an amplitude of the scanning pulse WS, is set as ΔV. When the scanning pulse WS transitions from the high level to the low level, the sampling transistor 23 enters a conduction state, and thus a light-emission signal, that is, a signal voltage $V_{sig}$ of a video signal, is written. In addition, after writing of the signal voltage $V_{sig}$, the scanning pulse WS transitions from the low level to the high level at a period between time $t_1$ and time $t_2$. Here, as illustrated in FIG. 6, a parasitic capacitance $C_p$ occurs between the scanning line 31 and the gate electrode of the drive transistor 22 due to a diffusion capacitance of the transistor, or an interlayer capacitance of a layout.

Due to an effect of the parasitic capacitance $C_p$, coupling by capacitive coupling of a voltage variation (=amplitude of the scanning pulse WS) ΔV of the scanning line 31 is applied to the gate electrode of the drive transistor 22. According to this, a voltage $V_{gs}$ between the gate and the source of the drive transistor 22 varies by an amount of $\Delta V_{gs}$. The voltage $V_{gs}$ between the gate and source after variation determines the final light-emission luminance. Here, when a capacitance value of the retention capacitor 24 is set as $C_p$, an amount of variation $\Delta V_{gs}$ in the voltage $V_{gs}$ between the gate and the source of the drive transistor 22 is given by the following Equation.

$$\Delta V_{gs}=\Delta V\times\{C_p/(C_p+C_p)\}-\int I_{ws}(t_1<t<t_2)$$

Figure 7:
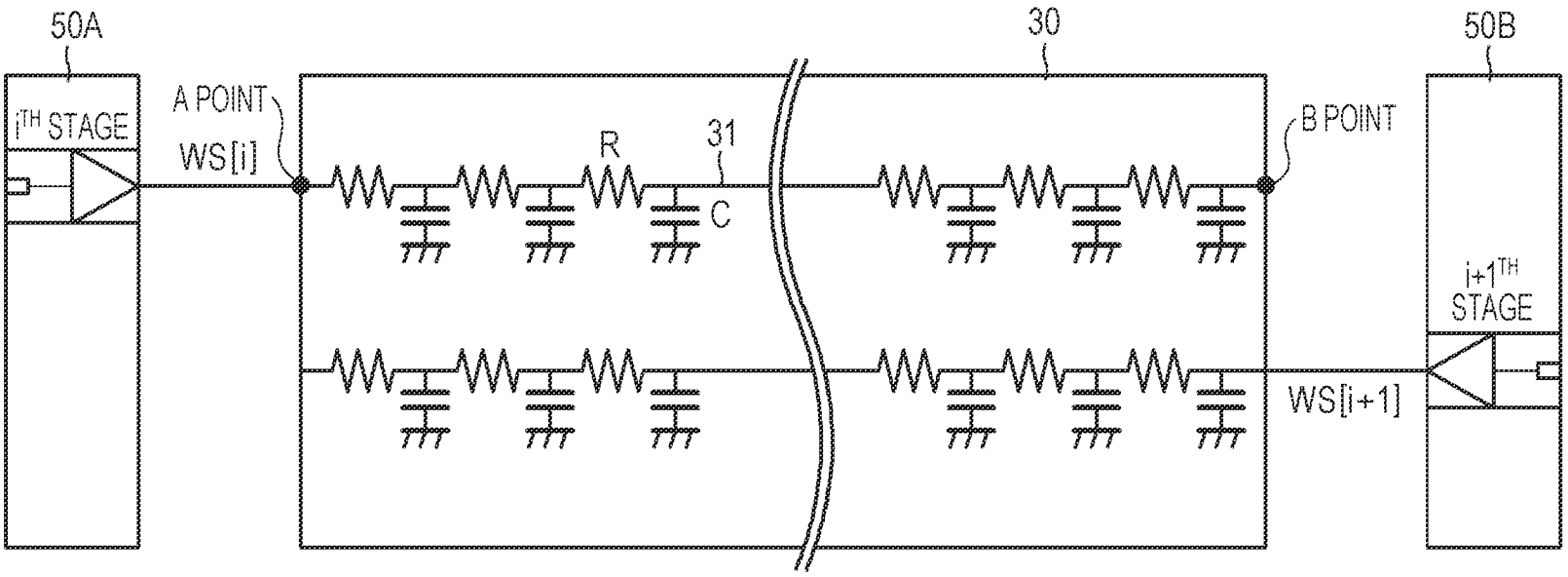
FIG. 7 is an equivalent circuit diagram illustrating an RC distribution constant of the scanning line.

In the case of the one-side driving according to the related art, the transient difference of the scanning pulse WS occurs at the right and left of the display panel 80. In this case, the effect of the amount of variation $\Delta V_{gs}$ in the voltage $V_{gs}$ between the gate and the source of the drive transistor 22 is different between the right side and the left side of the display panel 80. With regard to this phenomenon, description will be made in detail by giving attention to driving of the drive unit 50A on the left side. As illustrated in FIG. 7, an interconnection resistance R or an electrostatic capacitance C exist in the scanning line 31. In addition, in accordance with a distribution constant of the RC, as illustrated in FIG. 8, the transient becomes steep on the left side (that is, "A" point in the vicinity of the drive unit 50A) of the display panel 80, and the transient becomes gentle at the right side ("B" point far away from the drive unit 50A) of the display panel 80.

Figure 8:
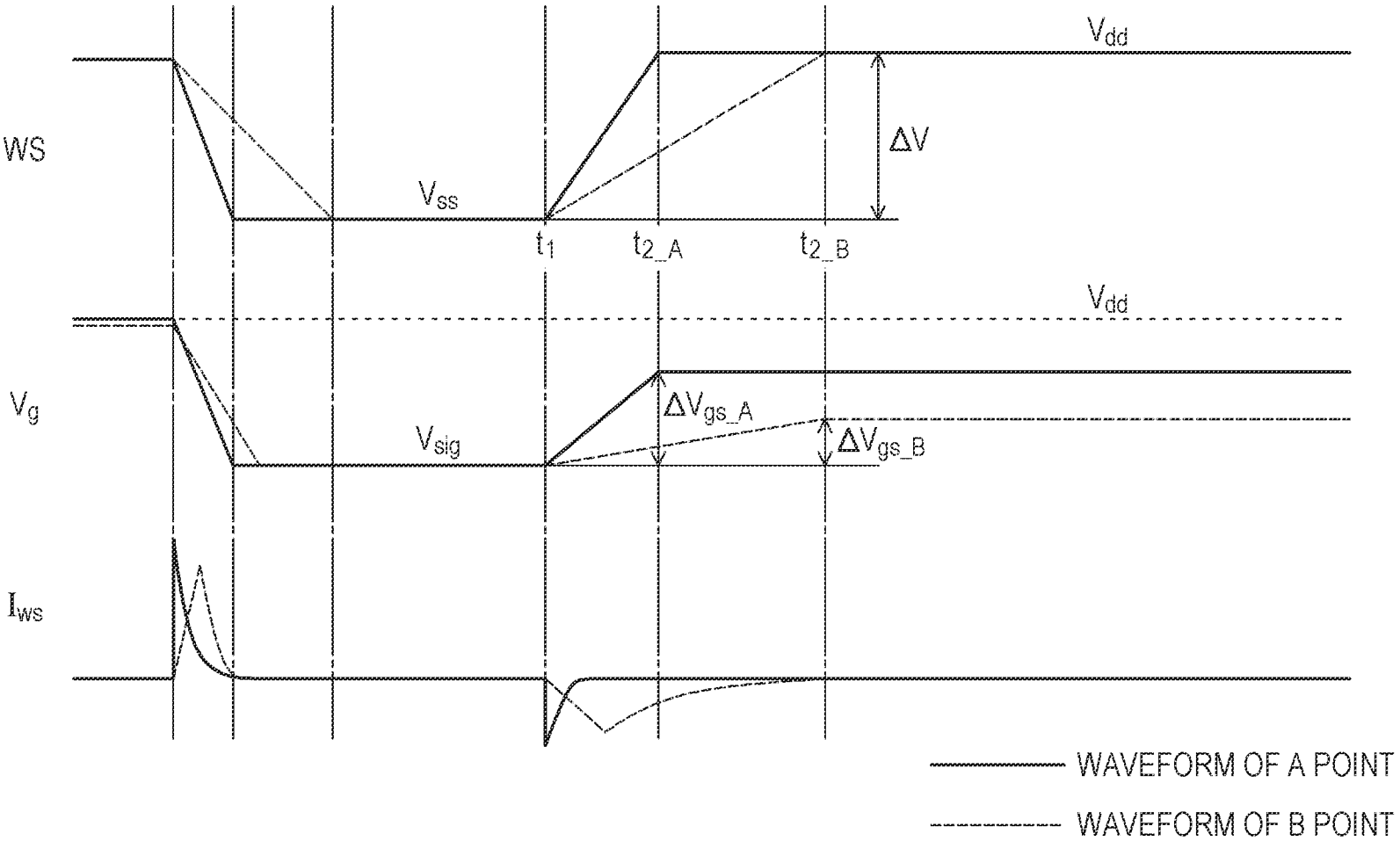
FIG. 8 is a timing waveform chart illustrating a transient difference of a scanning pulse WS at a left portion and a right portion of the display panel.

FIG. 8 illustrates waveforms of the scanning pulse WS, the gate voltage $V_g$ of the drive transistor 22, and the current $I_{WS}$ that flows through the sampling transistor 23. In FIG. 8, a waveform of the "A" point is drawn with a solid-line, and a waveform of the "B" point is drawn with a broken line. At the portion ("A" point) on the left side of the display panel 80 in which the transient is steep, a value of $\int I_{ws}(t_1<t<t_{2_A})$ is small, and thus the amount of variation $\Delta V_{gs_A}$ in the voltage $V_{gs}$ between the gate and the source of the drive transistor 22 is large. At the portion ("B" point) on the right side of the display panel 80 in which the transient is gentle, value of $\int I_{ws}(t_1<t<t_{2B})$ is large, and thus the amount of variation $\Delta V_{gs_B}$ in the voltage $V_{gs}$ between the gate and the source of the drive transistor 22 is small.

Here, when mobility of a semiconductor thin film that constitutes the channel of the drive transistor 22 is set as u, a channel width is set as W, a channel length is set as L, a gate capacitance per unit area is set as $C_{OX}$, and a threshold voltage is set as $V_{th}$, the drive current $I_{ds}$ of the organic EL element 21 during final light-emission is given by the following Equation.

$$I_{ds}=(1/2)u(W/L)C_{ox}\{V_{dd}-(V_{sig}+\Delta V_{gs})-|V_{th}|\}^2$$

As described above, the drive current $I_{ds}$ during final light-emission is determined by the above-described Equation. Accordingly, it becomes dark at the portion ("A" point) on the left side of the display panel 80 in which the amount of variation $\Delta V_{gs}$ in the voltage $V_{gs}$ between the gate and the source of the drive transistor 22 is large. In addition, it becomes bright at the portion ("B" point") on the right side of the display panel 80 in which the amount of variation $\Delta V_{gs}$ in the voltage $V_{gs}$ between the gate and the source of the drive transistor 22 is small. Accordingly, the luminance distribution (shading) occurs.

One-Side Driving According to Embodiment

In the organic EL display device 10 according to this embodiment, the following configuration is employed for the countermeasure of the shading that occurs in the above-described one-side driving according to the related art. That is, as illustrated in FIG. 1, the switch units 60A and 60B are provided between the pixel array unit 30 and the two drive units 50A and 50B, pixels on an odd row side are driven by using output stages of one drive unit between the two drive units 50A and 50B, and pixels on an even row side are driven by using output stages of the other drive unit. In addition, the driving is inverted for each field. The control is executed under the control by the control unit 40.

Figure 9:
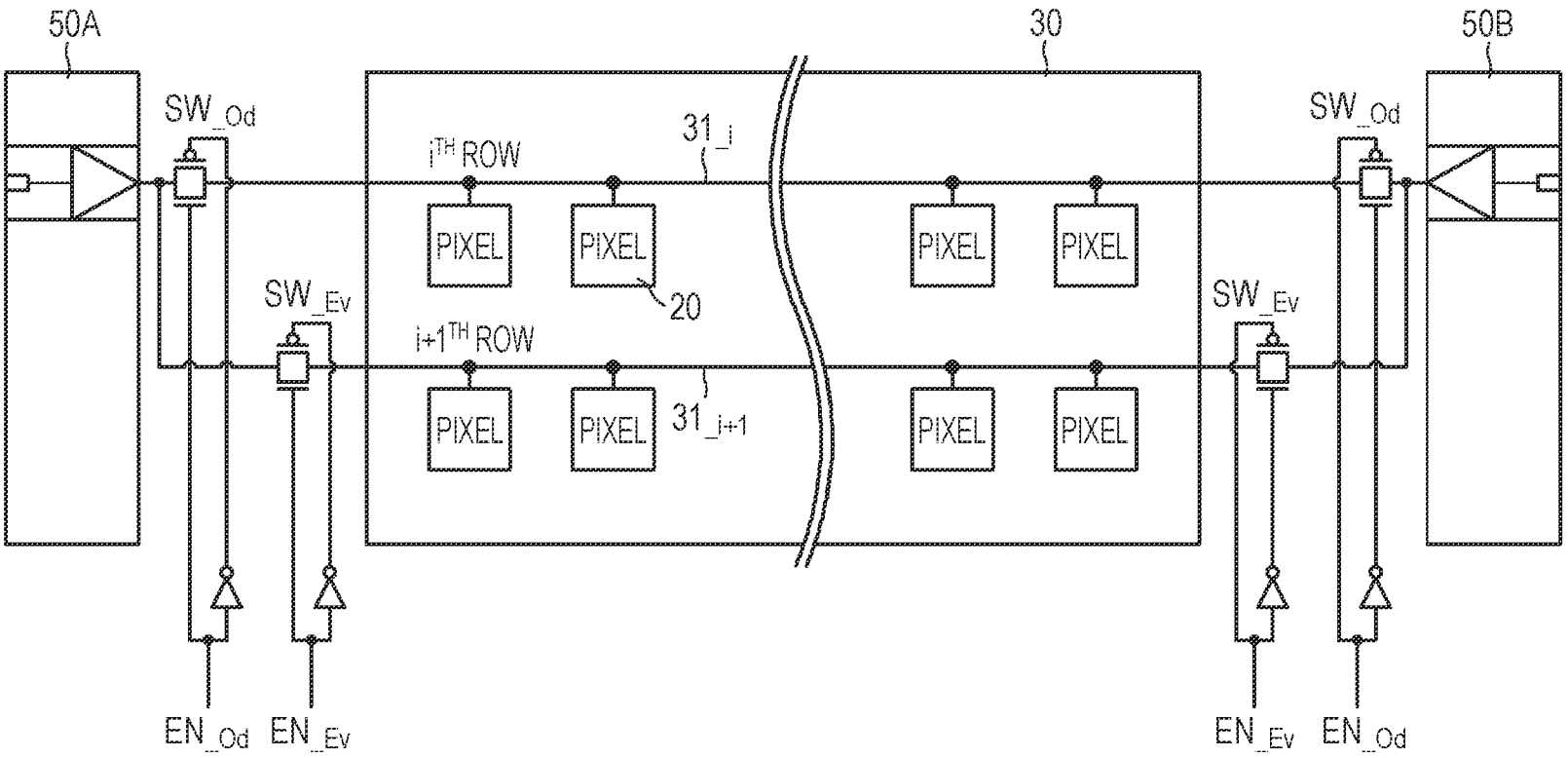
FIG. 9 is a configuration view illustrating a configuration example of one-side driving according to the embodiment in which attention is given to driving of pixels in an $i^{th}$ pixel row and an $i+1^{th}$ pixel row.

FIG. 9 illustrates a configuration example of the one-side driving according to the embodiment in which attention is given to driving of pixels in an $i^{th}$ row and an $i+1^{th}$ row. Here, it is assumed that the $i^{th}$ pixel row is set as an odd row, and the $i+1^{th}$ pixel row is set as an even row. In a corresponding relationship with FIG. 1, the two switches $SW_{_Od}$ and $SW_{_Ev}$ which constitute the switch units 60A and 60B have a switch circuit configuration in which a P-channel type transistor and an N-channel type transistor are connected in parallel with each other. However, with regard to the two switches $SW_{_Od}$ and $SW_{_Ev}$, there is no limitation to the switch circuit configuration, and a switch circuit configuration constituted by the P-channel type transistor alone, or the N-channel type transistor alone is also possible.

In FIG. 9, the drive unit 50A may be set as a first drive unit, the drive unit 50B may be set as a second drive unit, a scanning line $\mathbf{31}_{_i}$ of an $i^{th}$ row may be set as a first scanning line, and a scanning line $\mathbf{31}_{_i+1}$ of an $i+1^{th}$ row may be set as a second scanning line. At this time, the switch $SW_{_Od}$ on the drive unit 50A side may be set as a first switch, the switch $SW_{_Od}$ on the drive unit 50B side may be set as a second switch, the switch $SW_{_Ev}$ on the drive unit 50A side may be set as a third switch, and the switch $SW_{_Ev}$ on the drive unit 50B side may be set as a fourth switch.

Figure 10:
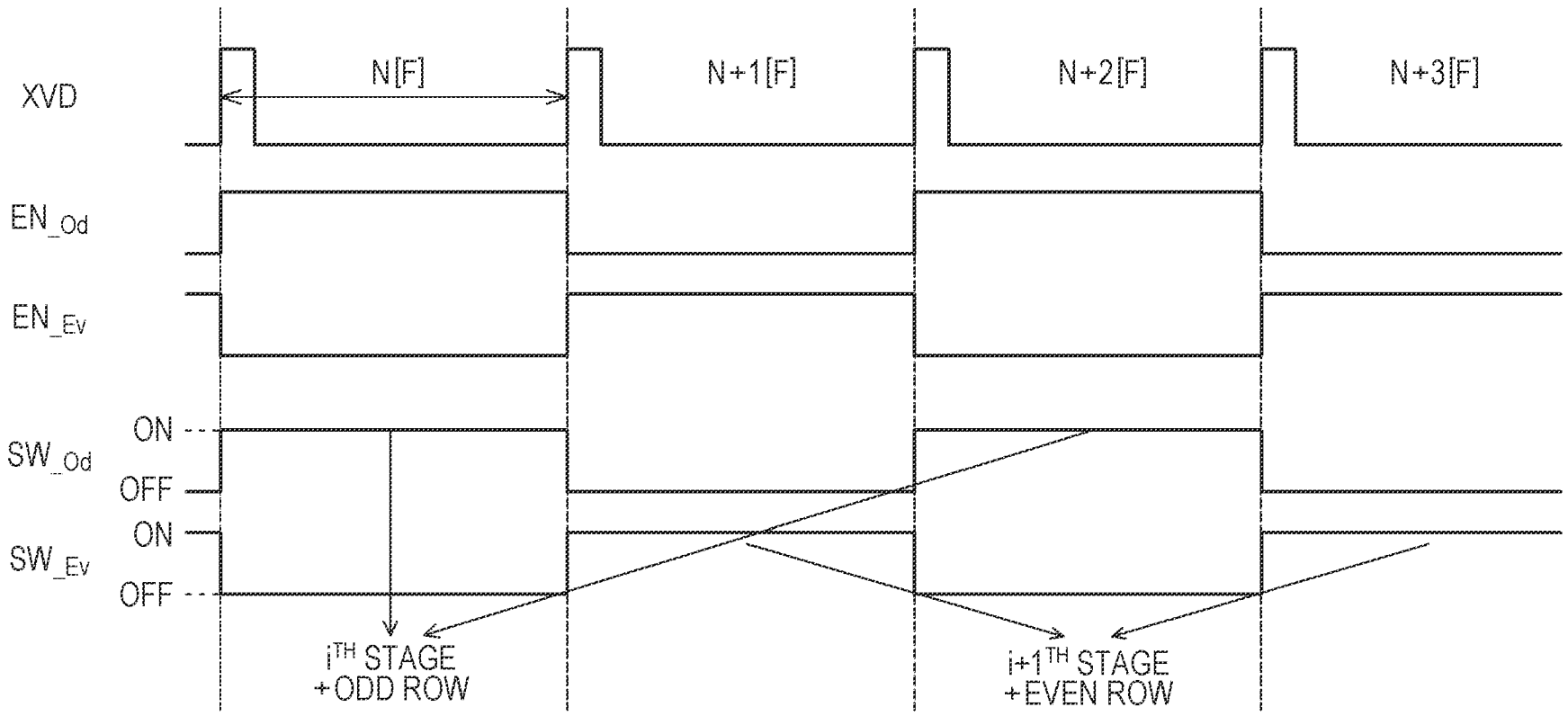
FIG. 10 is a timing waveform chart illustrating a drive timing of the one-side driving according to the embodiment.

FIG. 10 illustrates a driving timing of the one-side driving according to the embodiment. FIG. 10 illustrates a vertical synchronization signal XVD, a timing relationship between drive signals $EN_{_Od}$ and $EN_{_Ev}$ of the two switches $SW_{_Od}$ and $SW_{_Ev}$, and on/off operation states of the two switches $SW_{_Od}$ and $SW_{_Ev}$.

Figure 11A:
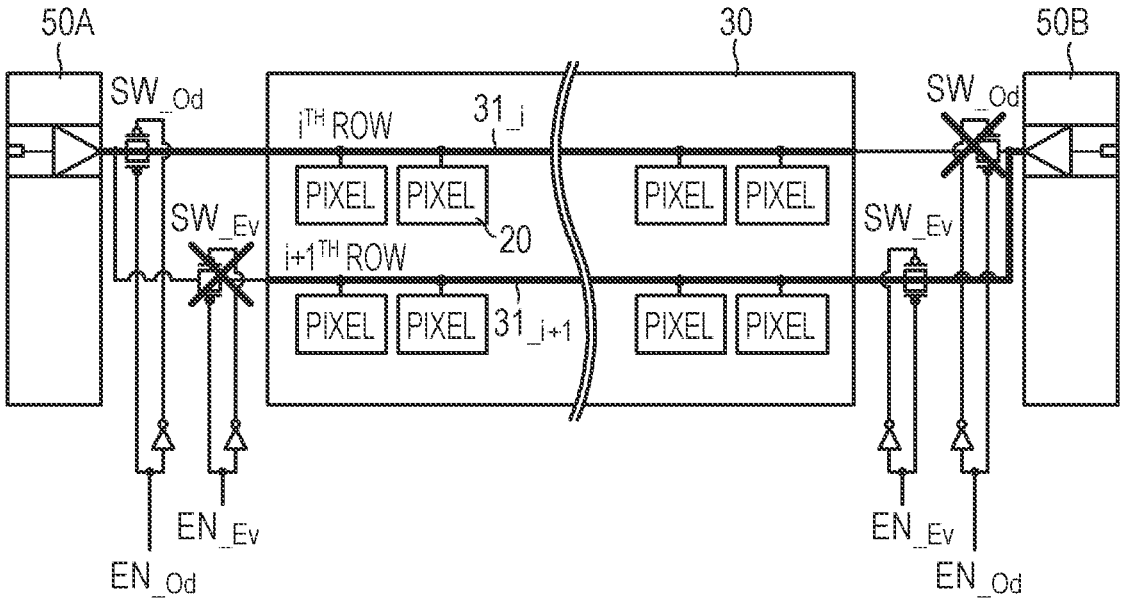
FIG. 11A is a view illustrating an operation of driving of an $i^{th}$ stage (odd stage) in the one-side driving according to the embodiment.

During an arbitrary N field, the switch $SW_{_Od}$ is turned on at the output stage of one drive unit between the two drive units 50A and 50B, and the switch $SW_{_Ev}$ is turned on at the output stage of the other drive unit. In an example of FIG. 10, as illustrated in FIG. 11A, the switch $SW_{_Od}$ is turned on during output of the drive unit 50A on the left side, and the switch $SW_{_Ev}$ is turned on during output of the drive unit 50B on the right side. According to this, the drive units 50A and 50B are connected to the scanning lines $\mathbf{31}_{_1}$ and $\mathbf{31}_{_i+1}$ of the $i^{th}$ row and the $i+1^{th}$ row for each field in a nesting manner, and thus a so-called nesting driving is performed.

Figure 11B:
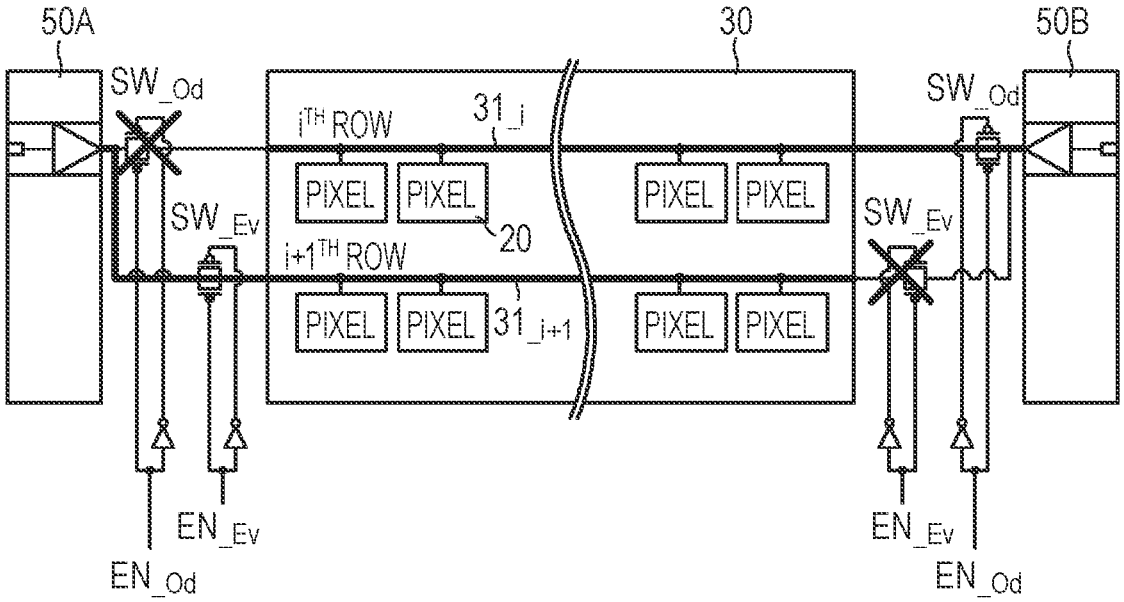
FIG. 11B is a view illustrating an operation of driving of an $i+1^{th}$ stage (even stage) in the one-side driving according to the embodiment.

Next, the polarities of the drive signal $EN_{_Od}$ and $EN_{_Ev}$ of the two switches $SW_{_Od}$ and $SW_{_Ev}$ are inverted during N+1 field. In an example of FIG. 10, as illustrated in FIG. 11B, the switch $SW_{_Ev}$ is turned on during output of the drive unit 50A on the left side, and the switch $SW_{_Od}$ is turned on during output of the drive unit 50B on the right side. That is, driving, in which outputs of the two drive units 50A and 50B are horizontally inverted for each field, is performed.

Figure 12A:
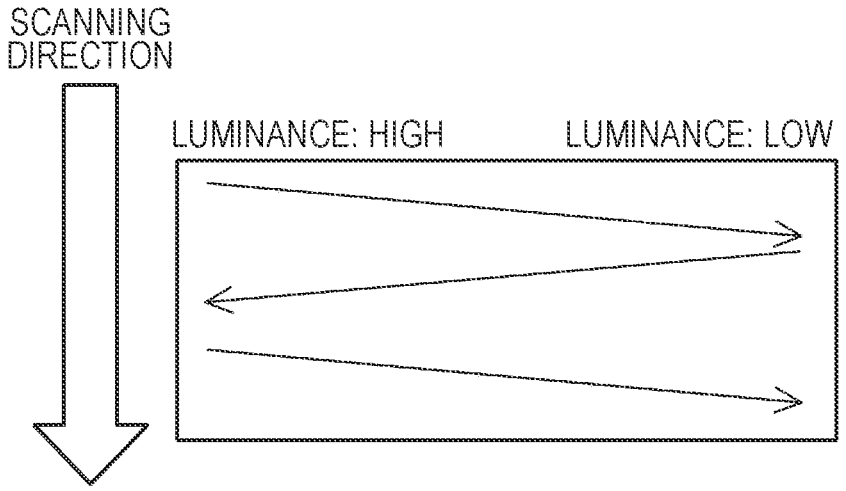
FIG. 12A is a view illustrating luminance distribution by one-side driving according to the related art in which field inversion does not occur.
Figure 12B:
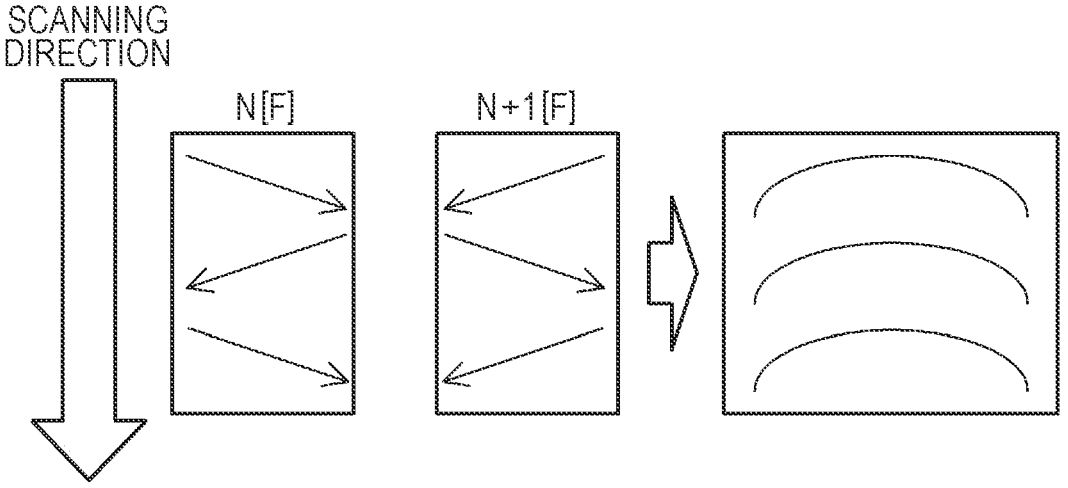
FIG. 12B is a view illustrating luminance distribution by the one-side driving according to the embodiment in which the field inversion occurs.

FIGS. 12A and 12B illustrate luminance distribution by the one-side driving. FIG. 12A illustrates luminance distribution by the one-side driving according to the related art in which field inversion does not occur, and FIG. 12B illustrates luminance distribution by the one-side driving according to the embodiment in which the field inversion occurs.

In the case of the one-side driving according to the embodiment, the luminance distribution occurs for each one field toward one side, but the luminance distribution is inverted for each field. Accordingly, with regard to visual information, the luminance is composed, and thus a luminance difference becomes smooth. As a result, it is possible to make confirmation of the shading with eyes difficult. In general, when the luminance difference is approximately 20[%], the luminance difference is confirmed with eyes as shading, but the inversion for each field is used, and thus it is possible to make a luminance difference of approximately two times smooth. When a driving speed further increases, a spatial frequency of the luminance difference further increases, and thus even in a relatively larger luminance difference, smoothing occurs.

As described above, the two drive units 50A and 50B, which are disposed on the same substrate as the pixel array unit 30 with the pixel array unit 30 interposed therebetween, have output stages in a number that is half of the number of pixel rows of the pixel array unit 30, and thus it is possible to construct the output stages with a pitch two times a pixel pitch. Accordingly, in the display panel 80 in which the drive units 50A and 50B are built-in, even when narrowing of the pixel pitch is in progress along with high-definition, it is possible to suppress an increase in an area of a frame portion. Accordingly, it is possible to manufacture a small-sized display panel, and it is possible to reduce the cost.

In addition, according to the one-side driving in which output stages of one drive unit between the two drive units 50A and 50B drive pixels on an odd row side, output stages of the other drive unit drive pixels on an even row side, and the driving is inverted for each field, the luminance distribution (shading) inside the panel is inverted for each field. Accordingly, with regard to visual information, luminance is composed (retina composition). According to this, a luminance difference is averaged, and thus it is possible to mitigate shading which occurs during the one-side driving.

Modification Example of Embodiment

Figure 13:
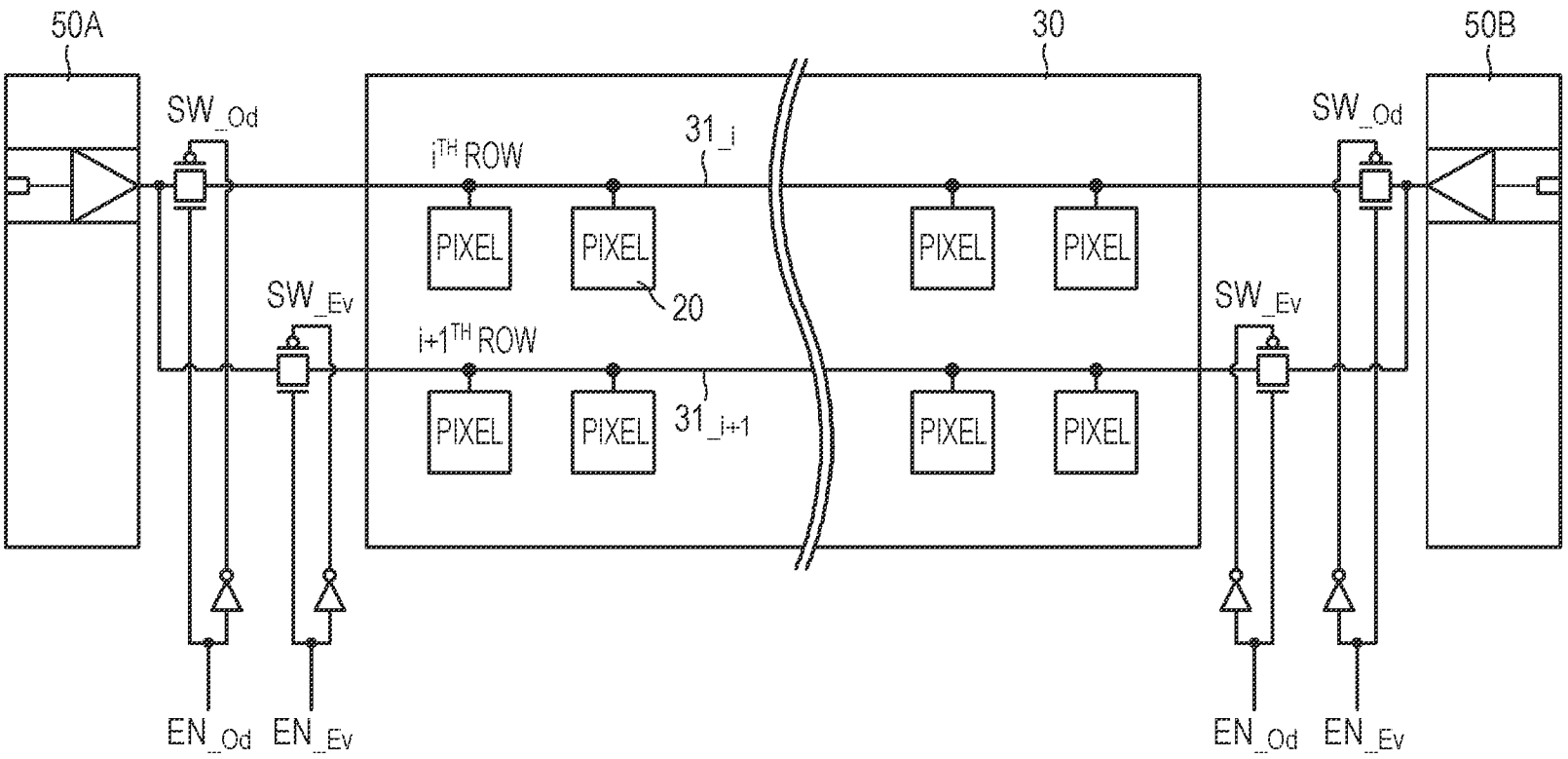
FIG. 13 is a configuration view illustrating another circuit example of nest driving.

In the above-described embodiment, the nesting driving with respect to the first and second scanning lines ($\mathbf{31}_{_i}$ and $\mathbf{31}_{_i+1}$) by the first and second drive units (50A and 50B) has been described with reference to the circuit in FIG. 9 as an example, but there is no limitation to the circuit example. For example, it is possible to consider various circuit examples such as a circuit example in FIG. 13 in which on the drive unit 50B side, an inverter is disposed on the P-channel type transistor side of the switches $SW_{_Od}$ and $SW_{_Ev}$, and the drive signal $EN_{_Od}$ and the drive signal $EN_{_Ev}$ are switched from each other.

In addition, in the above-described embodiment, description has been given to a case applied to the organic EL display device using the organic EL element as the light-emitting unit of the pixel 20 as an example, but the technology of the present disclosure is not limited to the application example. Specifically, the technology of the present disclosure is applicable to a display device using a current drive type light-emitting element such as an inorganic EL element, an LED element, and a semiconductor laser element in which light-emission luminance varies in accordance with a value of a current that flows through a device.

In addition, the technology of the present disclosure is not limited to the application to the display device using the current drive type light-emitting element, and is applicable to a display device using a voltage drive type light-emitting element. That is, the technology of the present disclosure is applicable to overall display devices which employ a panel built-in type configuration in which a drive unit is disposed on the same substrate as a pixel array unit.

Electronic Apparatus

The above-described display device of the present disclosure can be used as display sections (display devices) of electronic apparatuses in all fields which display a video signal input to the electronic apparatuses or a video signal generated inside the electronic apparatuses as an image or a video. As an example, the display device of the present disclosure may be used as display sections of a television set, a digital still camera, a notebook-type personal computer, a portable terminal apparatus such as a cellular phone, a video camera, a head mount display, and the like.

As described above, in the electronic apparatuses of various fields, when the display device of the present disclosure is used as a display section, the following effect can be obtained. That is, according to the technology of the present disclosure, it is possible to manufacture a small-sized display panel, and thus it is possible to raise a theoretical yield. Accordingly, it is possible to reduce the cost of the electronic apparatuses including the display section. In addition, the size of the display panel is reduced, and thus it is possible to realize a decrease in a set size. Accordingly, it is possible to raise the degree of freedom in design of products (electronic apparatuses).

The display device of the present disclosure includes a module-shaped display device having a sealed configuration. An example thereof corresponds to a display module that is formed by bonding a counterpart such as transparent glass to the pixel array unit. However, the display module may be provided with a circuit unit that inputs and outputs a signal and the like from the outside to the pixel array unit, a flexible print circuit (FPC), and the like. Hereinafter, as specific examples of the electronic apparatuses using the display device of the present disclosure, a digital still camera and a head mount display are exemplified. However, the specific examples exemplified here are illustrative only, and there is no limitation thereto.

First Specific Example

Figure 14A:
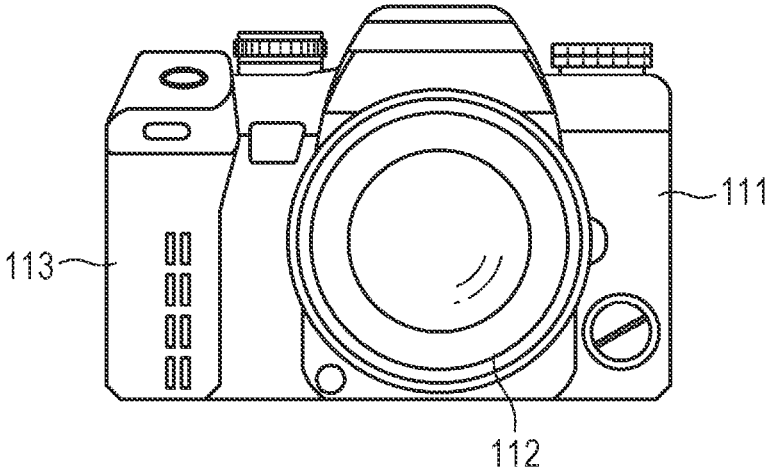
Figure 14B:
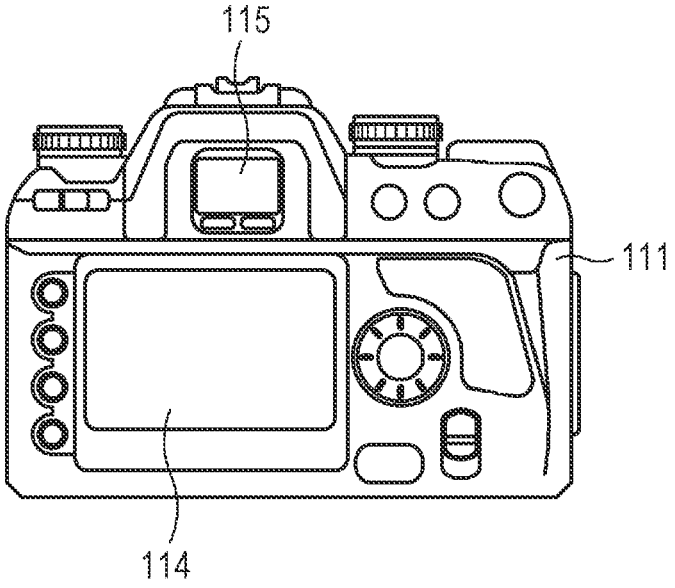

FIGS. 14A and 14B are external appearance views of a lens-interchangeable single-lens reflex type digital still camera, in which FIG. 14A is a front view and FIG. 14B is a rear view. For example, the lens-interchangeable single-lens reflex type digital still camera includes an interchangeable photographing lens unit (interchangeable lens) 112 on a front right side of a camera main body section (camera body) 111, and a gripping section 113, which is used by a photographer for gripping, on a front left side.

In addition, a monitor 114 is provided at approximately the center of a rear surface of the camera main body section 111. A view finder 115 (eyepiece window) is provided on an upper portion of the monitor 114. The photographer can confirm an optical image of an object, which is introduced from the photographing lens unit 112, with eyes by looking through the view finder 115, and can determine compositional arrangement.

In the lens-interchangeable single-lens reflex type digital still camera having the above-described configuration, the display device of the present disclosure can be used as the view finder 115. That is, the lens-interchangeable single-lens reflex type digital still camera according to this example is manufactured by using the display device of the present disclosure as the view finder 115.

Second Specific Example

Figure 15:
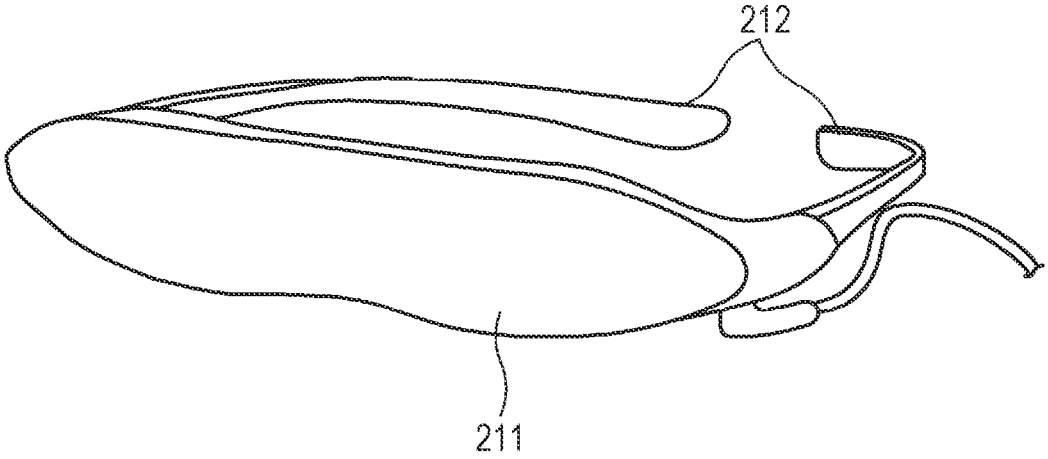
FIG. 15 is an external appearance view of a head mount display.

FIG. 15 is an external appearance view of a head mount display. For example, the head mount display includes ear hooking sections 212, which are used for mounting on the head of a user, on both sides of an eyeglass type display section 211. In the head mount display, the display device of the present disclosure can be used as the display section 211. That is, the head mount display according to this example is manufactured by using the display device of the present disclosure as the display section 211 thereof.

The present disclosure may employ the following configurations.

[1] A display device, including:

a pixel array unit in which pixels including a light-emitting unit are arranged in a matrix shape;

two drive units which are disposed on the same substrate as the pixel array unit with the pixel array unit interposed therebetween, which have output stages in a number that is half of the number of pixel rows of the pixel array unit, and in which the output stages are in charge of driving of pixels on an odd row side and on an even row side; and a control unit which performs control of driving the pixels on the odd row side by using the output stages of one drive unit between the two drive units, of driving the pixels on the even row side by using the output stages of the other drive unit, and of inverting the driving for each field.

[2] The display device according to [1], wherein each of the two drive units has two switches which selectively establish a connection between each output stage and each scanning line on an odd row side, and a connection between the output stage and each scanning line on an even row side.

[3] The display device according to [2], wherein when turning on a switch on an odd row side and turning off a switch on an even row side with respect to the two switches on one side of the two drive units, the control unit turns on a switch on an even row side and turns off a switch on an odd row side with respect to the two switches on the other side of the two drive units, and switches on/off control of the two switches for each field.

[4] A display device, including:

a pixel array unit in which pixels including a light-emitting unit are arranged in a matrix shape;

two drive units which are disposed on the same substrate as the pixel array unit with the pixel array unit interposed therebetween, which have output stages in a number that is half of the number of pixel rows of the pixel array unit, and in which the output stages are in charge of driving of pixels on an odd row side and on an even row side; and a switch unit in which two switches, which selectively establish a connection between each output stage of the two drive units and each scanning line on an odd row side and a connection between the output stage and each scanning line on an even row side, are disposed for every output stages of the two drive units.

[5] A display device, including:

a pixel array unit in which pixels including a light-emitting unit are arranged in a matrix shape;

a first scanning line that is commonly connected to pixels which are arranged in a first row;

a first switch;

a second switch;

a first drive unit; and a second drive unit, wherein an output stage of the first drive unit is connected to one end of the first scanning line through the first switch, an output stage of the second drive unit is connected to the other end of the first scanning line through the second switch, and when the first switch enters a conduction state, the second switch enters a non-conduction state.

[6] The display device according to [5], further including:

a second scanning line that is commonly connected to pixels which are arranged in a second row;

a third switch; and a fourth switch, wherein the output stage of the first drive unit is connected to an end of the second scanning line through the third switch, the output stage of the second drive unit is connected to the other end of the second scanning line through the fourth switch, when the third switch enters a conduction state, the fourth switch enters a non-conduction state, and when the first switch enters a conduction state, the third switch enters a non-conduction state.

[7] A method of driving a display device that includes a pixel array unit in which pixels including a light-emitting unit are arranged in a matrix shape, and two drive units which are disposed on the same substrate as the pixel array unit with the pixel array unit interposed therebetween, which have output stages in a number that is half of the number of pixel rows of the pixel array unit, and in which each of the output stages is in charge of driving of pixels on an odd row side and on an even row side, the method including:

driving pixels on the odd row side by using the output stages of one drive unit between the two drive units, driving pixels on the even row side by using the output stages of the other drive unit, and inverting the driving for each field.

[8] An electronic apparatus, including:

a display device including;

a pixel array unit in which pixels including a light-emitting unit are arranged in a matrix shape;

two drive units which are disposed on the same substrate as the pixel array unit with the pixel array unit interposed therebetween, which have output stages in a number that is half of the number of pixel rows of the pixel array unit, and in which the output stages are in charge of driving of pixels on an odd row side and on an even row side; and a control unit which performs control of driving the pixels on the odd row side by using the output stages of one drive unit between the two drive units, of driving the pixels on the even row side by using the output stages of the other drive unit, and of inverting the driving for each field.

It should be understood by those skilled in the art that various modifications, combinations, sub-combinations and alterations may occur depending on design requirements and other factors insofar as they are within the scope of the appended claims or the equivalents thereof.

What is claimed is:

1. A display device comprising:

a substrate;

a plurality of video signal lines disposed in columns;

a plurality of pixels that are arranged in pixel rows and pixel columns, and each pixel of the plurality of pixels including a capacitor, a sampling transistor configured to supply a video signal voltage supplied through a corresponding one of the plurality of video signal lines to the capacitor, a drive transistor configured to supply a driving current from a voltage source to a light-emitting unit according to a voltage stored in the capacitor, and a light emission control transistor electrically connected between the voltage source and the drive transistor;

a first drive unit and a second drive unit that are disposed on the substrate with the plurality of pixels interposed between the first drive unit and the second drive unit, wherein the first drive unit includes first output stages in a number that is half of a number of the pixel rows, each of the first output stages being electrically connected to pixels in two adjacent pixel rows of the pixel rows, and wherein the second drive unit includes second output stages in a number that is half of the number of the pixel rows, each of the second output stages being electrically connected to the pixels in the two adjacent pixel rows of the pixel rows;

a control unit that is configured to control the first drive unit to drive only sampling transistors of the plurality of pixels on an odd row side using the first output stages, control the second drive unit to drive only sampling transistors of the plurality of pixels on an even row side using the second output stages, control the first drive unit to drive only the sampling transistors of the plurality of pixels on the even row side using the first output stages, and control the second drive unit to drive only the sampling transistors of the plurality of pixels on the odd row side using the second output stages; and a first plurality of switches, wherein each of the first output stages is connected to two switches of the first plurality of switches, wherein a first switch of the two switches is configured to selectively establish a connection between the each of the first output stages and a scanning line on the odd row side, and wherein a second switch of the two switches is configured to selectively establish a connection between the each of the first output stages and a scanning line on the even row side, and wherein the first switch of the two switches of the first plurality of switches includes a first P-channel type transistor and a first N-channel type transistor connected in parallel with the first P-channel type transistor, wherein the second switch of the two switches of the first plurality of switches includes a second P-channel type transistor and a second N-channel type transistor connected in parallel with the second P-channel type transistor, and wherein a gate of the second P-channel type transistor and a gate of the first N-channel type transistor receive a control signal having a same voltage level.

2. The display device according to claim 1, wherein the first plurality of switches is disposed on the substrate.

3. The display device according to claim 1, wherein the scanning line on the even row side is directly connected to gate terminals of the sampling transistors of the plurality of pixels on the even row side, and wherein the scanning line on the odd row side is directly connected to gate terminals of the sampling transistors of the plurality of pixels on the odd row side.

4. The display device according to claim 1, further comprising a plurality of control signal lines disposed in rows, the plurality of control signal lines connected to both of the first drive unit and the second drive unit.

5. The display device according to claim 4, wherein a corresponding one of the plurality of control signal lines is configured to supply the control signal to only sampling transistors in pixels in a second pixel row.

6. The display device according to claim 4, wherein a corresponding one of the first output stages and a corresponding one of the second output stages are configured to be electrically connected to first pixels in a first pixel row through a corresponding one of the plurality of control signal lines, and wherein the corresponding one of the first output stages and the corresponding one of the second output stages are configured to be electrically connected to second pixels in a second pixel row through a corresponding second one of the plurality of control signal lines.

7. The display device according to claim 6, wherein the sampling transistor included in a pixel of the first pixel row is configured to sample the video signal voltage according to a control signal supplied from the corresponding one of the plurality of control signal lines, and wherein the sampling transistor included in a pixel of the second pixel row is configured to sample the video signal voltage according to a control signal supplied from the corresponding second one of the plurality of control signal lines.

8. The display device according to claim 1, wherein each of the first drive unit and the second drive unit includes a shift register circuit.

9. The display device according to claim 1, wherein the second drive unit has two switches which selectively establish a connection between each of the second output stages and each scanning line on the odd row side, and a connection between each of the second output stages and each scanning line on the even row side.

10. The display device according to claim 9, wherein each of the first drive unit and the second drive unit includes a shift register circuit.

11. The display device according to claim 10, wherein the control unit is further configured to:

turn on a first switch on the odd row side and turn off a first switch on the even row side with respect to the two switches on one side of the first drive unit and the second drive unit, and turn on a second switch on the even row side and turn off a second switch on the odd row side with respect to the two switches on the other side of the first drive unit and the second drive unit.

12. The display device according to claim 1, wherein the control unit which performs control of driving the plurality of pixels on the odd row side by using one of the first output stages or the second output stages, of driving the plurality of pixels on the even row side by using other one of the first output stages or the second output stages, and of inverting the driving for each field.

13. A display device comprising:

a substrate;

a plurality of video signal lines disposed in columns;

a plurality of pixels that are arranged in pixel rows and pixel columns, and each pixel of the plurality of pixels including a capacitor, a sampling transistor configured to supply a video signal voltage supplied through a corresponding one of the plurality of video signal lines to the capacitor, a drive transistor configured to supply a driving current from a voltage source to a light-emitting unit according to a voltage stored in the capacitor, and a light emission control transistor electrically connected between the voltage source and the drive transistor;

a first drive unit and a second drive unit that are disposed on the substrate with the plurality of pixels interposed between the first drive unit and the second drive unit, wherein the first drive unit includes first output stages in a number that is half of a number of the pixel rows, each of the first output stages being electrically connected to pixels in two adjacent pixel rows of the pixel rows, and wherein the second drive unit includes second output stages in a number that is half of the number of the pixel rows, each of the second output stages being electrically connected to the pixels in the two adjacent pixel rows of the pixel rows;

a control unit that is configured to control the first drive unit to drive only sampling transistors of the plurality of pixels on an odd row side using the first output stages, control the second drive unit to drive only sampling transistors of the plurality of pixels on an even row side using the second output stages, control the first drive unit to drive only the sampling transistors of the plurality of pixels on the even row side using the first output stages, and control the second drive unit to drive only the sampling transistors of the plurality of pixels on the odd row side using the second output stages;

a first plurality of switches, wherein each of the first output stages is connected to two switches of the first plurality of switches, wherein a first switch of the two switches is configured to selectively establish a connection between the each of the first output stages and a scanning line on the odd row side, and wherein a second switch of the two switches is configured to selectively establish a connection between the each of the first output stages and a scanning line on the even row side; and a second plurality of switches that is separate from the first plurality of switches, wherein each of the second output stages is connected to two switches of the second plurality of switches, wherein a first switch of the two switches of the second plurality of switches is configured to selectively establish a connection between the each of the second output stages and the scanning line on the even row side, and wherein a second switch of the two switches of the second plurality of switches is configured to selectively establish a connection between the each of the second output stages and the scanning line on the odd row side, wherein when turning on the first switch of the first plurality of switches on the odd row side and turning off the second switch of the first plurality of switches on the even row side, the control unit is configured to turn on the first switch of the second plurality of switches, and turn off the second switch of the second plurality of switches, and wherein the first switch of the two switches of the second plurality of switches includes a first P-channel type transistor and a first N-channel type transistor connected in parallel with the first P-channel type transistor, wherein the second switch of the two switches of the second plurality of switches includes a second P-channel type transistor and a second N-channel type transistor connected in parallel with the second P-channel type transistor, and wherein a gate of the second P-channel type transistor and a gate of the first N-channel type transistor receive a control signal having a same voltage level.

14. A method of driving a display device that includes a substrate, a pixel array unit including a plurality of pixels that are arranged in a matrix shape and disposed on the substrate, each pixel of the plurality of pixels including a light-emitting unit, a drive transistor electrically connected between a voltage source and the light-emitting unit, the drive transistor configured to provide a current to the light-emitting unit, and a sampling transistor configured to sample a signal voltage and supply the signal voltage to a gate of the drive transistor, and two drive units that are disposed on the substrate with the pixel array unit interposed between the two drive units, each of the two drive units having output stages in a number that is half of a number of pixel rows of the pixel array unit, the method comprising:

driving, with a first drive unit of the two drive units, only sampling transistors of the plurality of pixels on an odd row side using output stages of the first drive unit;

driving, with a second drive unit of the two drive units, only sampling transistors of the plurality of pixels on an even row side using output stages of the second drive unit;

changing the output stages of the first drive unit to the even row side;

changing the output stages of the second drive unit to the odd row side;

driving, with the first drive unit, only the sampling transistors of the plurality of pixels on the even row side using the output stages of the first drive unit; and driving, with the second drive unit, only the sampling transistors of the plurality of pixels on the odd row side using the output stages of the second drive unit, wherein the display device further includes a first plurality of switches, wherein each of the output stages of the first drive unit is connected to two switches of the first plurality of switches, wherein a first switch of the two switches is configured to selectively establish a connection between the each of the output stages of the first drive unit and a scanning line on the odd row side, and wherein a second switch of the two switches is configured to selectively establish a connection between the each of the output stages of the first drive unit and a scanning line on the even row side, and wherein the first switch of the two switches of the first plurality of switches includes a first P-channel type transistor and a first N-channel type transistor connected in parallel with the first P-channel type transistor, wherein the second switch of the two switches of the first plurality of switches includes a second P-channel type transistor and a second N-channel type transistor connected in parallel with the second P-channel type transistor, and wherein a gate of the second P-channel type transistor and a gate of the first N-channel type transistor receive a control signal having a same voltage level.

15. An electronic apparatus comprising:

a display device that includes a substrate;

a pixel array unit including a plurality of pixels that are arranged in a matrix shape and disposed on the substrate, each of the plurality of pixels including a light-emitting unit, a drive transistor electrically connected between a voltage source and the light-emitting unit, the drive transistor configured to provide a current to the light-emitting unit, and a sampling transistor configured to sample a signal voltage and supply the signal voltage to a gate of the drive transistor;

two drive units that are disposed on the substrate with the pixel array unit interposed between the two drive units, each of the two drive units having output stages in a number that is half of a number of pixel rows of the pixel array unit, and each of the two drive units is configured to drive only sampling transistors of the plurality of pixels; and a control unit that is configured to control a first drive unit of the two drive units to drive only the sampling transistors of the plurality of pixels on an odd row side using output stages of the first drive unit, and control a second drive unit of the two drive units to drive only the sampling transistors of the plurality of pixels on an even row side using output stages of the second drive unit, control the first drive unit to drive only the sampling transistors of the plurality of pixels on the even row side using the output stages of the first drive unit, and control the second drive unit to drive only the sampling transistors of the plurality of pixels on the odd row side using the output stages of the second drive unit, wherein the display device further includes a first plurality of switches and a second plurality of switches that is separate from the first plurality of switches, wherein each of the output stages of the first drive unit is connected to two switches of the first plurality of switches, wherein a first switch of the two switches is configured to selectively establish a connection between the each of the output stages of the first drive unit and a scanning line on the odd row side, and wherein a second switch of the two switches is configured to selectively establish a connection between the each of the output stages of the first drive unit and a scanning line on the even row side, wherein each of the output stages of the second drive unit is connected to two switches of the second plurality of switches, wherein a first switch of the two switches of the second plurality of switches is configured to selectively establish a connection between the each of the output stages of the second drive unit and the scanning line on the even row side, and wherein a second switch of the two switches of the second plurality of switches is configured to selectively establish a connection between the each of the output stages of the second drive unit and the scanning line on the odd row side, wherein the first switch of the two switches of the second plurality of switches includes a first P-channel type transistor and a first N-channel type transistor connected in parallel with the first P-channel type transistor, wherein the second switch of the two switches of the second plurality of switches includes a second P-channel type transistor and a second N-channel type transistor connected in parallel with the second P-channel type transistor, and wherein a gate of the second P-channel type transistor and a gate of the first N-channel type transistor receive a control signal having a same voltage level.

16. An electronic apparatus comprising:

a display device that includes a substrate;

a pixel array unit including a plurality of pixels that are arranged in a matrix shape and disposed on the substrate, each of the plurality of pixels including a light-emitting unit, a drive transistor electrically connected between a voltage source and the light-emitting unit, the drive transistor configured to provide a current to the light-emitting unit, and a sampling transistor configured to sample a signal voltage and supply the signal voltage to a gate of the drive transistor;

two drive units that are disposed on the substrate with the pixel array unit interposed between the two drive units, each of the two drive units having output stages in a number that is half of a number of pixel rows of the pixel array unit, and each of the two drive units is configured to drive only sampling transistors of the plurality of pixels; and a control unit that is configured to control a first drive unit of the two drive units to drive only the sampling transistors of the plurality of pixels on an odd row side using output stages of the first drive unit, and control a second drive unit of the two drive units to drive only the sampling transistors of the plurality of pixels on an even row side using output stages of the second drive unit, control the first drive unit to drive only the sampling transistors of the plurality of pixels on the even row side using the output stages of the first drive unit, and control the second drive unit to drive only the sampling transistors of the plurality of pixels on the odd row side using the output stages of the second drive unit; and a first plurality of switches, wherein each of the output stages of the first drive unit is connected to two switches of the first plurality of switches, wherein a first switch of the two switches is configured to selectively establish a connection between the each of the output stages of the first drive unit and a scanning line on the odd row side, and wherein a second switch of the two switches is configured to selectively establish a connection between the each of the output stages of the first drive unit and a scanning line on the even row side, and wherein the first switch of the two switches of the first plurality of switches includes a first P-channel type transistor and a first N-channel type transistor connected in parallel with the first P-channel type transistor, wherein the second switch of the two switches of the first plurality of switches includes a second P-channel type transistor and a second N-channel type transistor connected in parallel with the second P-channel type transistor, and wherein a gate of the second P-channel type transistor and a gate of the first N-channel type transistor receive a control signal having a same voltage level.

17. An electronic apparatus comprising:

a display device that includes a substrate;

a pixel array unit including a plurality of pixels that are arranged in a matrix shape and disposed on the substrate, each of the plurality of pixels including a light-emitting unit, a drive transistor electrically connected between a voltage source and the light-emitting unit, the drive transistor configured to provide a current to the light-emitting unit, and a sampling transistor configured to sample a signal voltage and supply the signal voltage to a gate of the drive transistor;

two drive units that are disposed on the substrate with the pixel array unit interposed between the two drive units, each of the two drive units having output stages in a number that is half of a number of pixel rows of the pixel array unit, and each of the two drive units is configured to drive only sampling transistors of the plurality of pixels;

a control unit that is configured to control a first drive unit of the two drive units to drive only the sampling transistors of the plurality of pixels on an odd row side using output stages of the first drive unit, and control a second drive unit of the two drive units to drive only the sampling transistors of the plurality of pixels on an even row side using output stages of the second drive unit, control the first drive unit to drive only the sampling transistors of the plurality of pixels on the even row side using the output stages of the first drive unit, and control the second drive unit to drive only the sampling transistors of the plurality of pixels on the odd row side using the output stages of the second drive unit; and a first plurality of switches; and a second plurality of switches that is separate from the first plurality of switches, wherein each of the output stages of the first drive unit is connected to two switches of the first plurality of switches, wherein a first switch of the two switches is configured to selectively establish a connection between the each of the output stages of the first drive unit and a scanning line on the odd row side, and wherein a second switch of the two switches is configured to selectively establish a connection between the each of the output stages of the first drive unit and a scanning line on the even row side, wherein each of the output stages of the second drive unit is connected to two switches of the second plurality of switches, wherein a first switch of the two switches of the second plurality of switches is configured to selectively establish a connection between the each output stage of the second drive unit and the scanning line on the even row side, and wherein a second switch of the two switches of the second plurality of switches is configured to selectively establish a connection between the each of the output stages of the second drive unit and the scanning line on the odd row side, and wherein the first switch of the two switches of the second plurality of switches includes a first P-channel type transistor and a first N-channel type transistor connected in parallel with the first P-channel type transistor, wherein the second switch of the two switches of the second plurality of switches includes a second P-channel type transistor and a second N-channel type transistor connected in parallel with the second P-channel type transistor, and wherein a gate of the second P-channel type transistor and a gate of the first N-channel type transistor receive a control signal having a same voltage level.

* * * * *